US011475773B2

(12) United States Patent
Nakayamada

(10) Patent No.: US 11,475,773 B2
(45) Date of Patent: Oct. 18, 2022

(54) ALERT OF OCCURRENCE OF PRE-DANGEROUS STATE OF VEHICLE

(71) Applicant: NEC Corporation, Tokyo (JP)

(72) Inventor: Jun Nakayamada, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 17/264,055

(22) PCT Filed: Sep. 14, 2018

(86) PCT No.: PCT/JP2018/034166
§ 371 (c)(1),
(2) Date: Jan. 28, 2021

(87) PCT Pub. No.: WO2020/026461
PCT Pub. Date: Feb. 6, 2020

(65) Prior Publication Data

US 2021/0375139 A1 Dec. 2, 2021

(30) Foreign Application Priority Data

Aug. 3, 2018 (JP) ..... JP2018-146729

(51) Int. Cl.
*G08G 1/16* (2006.01)
*G08G 1/01* (2006.01)
(Continued)

(52) U.S. Cl.
CPC ..... *G08G 1/166* (2013.01); *G08G 1/0112* (2013.01); *G08G 1/091* (2013.01); *G08G 1/0962* (2013.01); *G08G 1/167* (2013.01)

(58) Field of Classification Search
CPC ..... G08G 1/166; G08G 1/0112; G08G 1/091; G08G 1/0962; G08G 1/167; G08G 1/096716; G08G 1/09675
See application file for complete search history.

(56) References Cited

U.S. PATENT DOCUMENTS 8,269,652 B2 * 9/2012 Seder ..... G01S 13/723 340/903
2004/0193347 A1 9/2004 Harumoto et al.
(Continued)

FOREIGN PATENT DOCUMENTS

JP 2002-140775 A 5/2002
JP 2005-056372 A 3/2005
(Continued)

OTHER PUBLICATIONS

International Search Report for PCT Application No. PCT/JP2018/034166, dated Dec. 18, 2018.
(Continued)

*Primary Examiner* — John A Tweel, Jr.

(57) ABSTRACT

The driver of a vehicle is alerted to occurrence of various pre-dangerous states. There is provided an information processing apparatus including a storage unit that stores information obtained by a traveling simulation of a vehicle in a virtual environment and indicating a pre-dangerous state before the vehicle is set in a dangerous state, a first acquirer that acquires actual information during traveling of the vehicle, and an alert controller that provides an alert of occurrence of the pre-dangerous state based on the actual information acquired by the first acquirer and the information indicating the pre-dangerous state.

10 Claims, 21 Drawing Sheets

(51) Int. Cl.
*G08G 1/09* (2006.01)
*G08G 1/0962* (2006.01)

(56) References Cited

U.S. PATENT DOCUMENTS

| | | | |
|---|---|---|---|
| 2016/0121791 | A1 | 5/2016 | Shimizu |
| 2017/0323568 | A1 | 11/2017 | Inoue et al. |

FOREIGN PATENT DOCUMENTS

| | | | |
|---|---|---|---|
| JP | 2005-134971 | A | 5/2005 |
| JP | 2009-015547 | A | 1/2009 |
| JP | 2009-251799 | A | 10/2009 |
| JP | 2009-282702 | A | 12/2009 |
| JP | 2016-091039 | A | 5/2016 |
| JP | 2017-174449 | A | 9/2017 |
| WO | 2016/157277 | A1 | 10/2016 |

OTHER PUBLICATIONS

Japanese Office Action for JP Application No. 2020-534038 dated Oct. 26, 2021 with English Translation.

* cited by examiner

401

411 412

| PRE-DANGEROUS STATE | ACTUAL INFORMATION | | | |
|---|---|---|---|---|
| | POSITION | SPEED | VIDEO | ··· |
| CUT-IN OF ANOTHER VEHICLE IN FRONT OF VEHICLE | | | | |
| LANE CHANGE | | | | |
| RUNNING-OUT OF PERSON FROM BLIND SPOT | | | | |
| ⋮ | ⋮ | ⋮ | ⋮ | ⋮ |

FIG. 4A

402

411

422

| PRE-DANGEROUS STATE | ALERT | | | | | | | | | | | | | | | |
|---|---|---|---|---|---|---|---|---|---|---|---|---|---|---|---|---|
| | SOUND | | | | LIGHT | | | | VIBRATION | | | | | | | |
| | POSITION | VOLUME | TIMING | ... | POSITION | CYCLE | TIMING | ... | POSITION | CYCLE | TIMING | ... | ... | ... | ... | ... |
| CUT-IN OF ANOTHER VEHICLE IN FRONT OF VEHICLE | | | | | | | | | | | | | | | | |
| LANE CHANGE | | | | | | | | | | | | | | | | |
| RUNNING-OUT OF PERSON FROM BLIND SPOT | | | | | | | | | | | | | | | | |
| ... | ... | ... | ... | ... | ... | ... | ... | ... | ... | ... | ... | ... | ... | ... | ... | ... |

FIG. 4B

801

| 811 | 812 | | |
|---|---|---|---|
| VEHICLE ID | INTER-VEHICLE COMMUNICATION INFORMATION | | |
| | POSITION | SPEED | ··· |
| | | | |
| | | | |
| | | | |

FIG. 8

1201

| 811 | 812 | | | 1211 | | |
|---|---|---|---|---|---|---|
| VEHICLE ID | INTER-VEHICLE COMMUNICATION INFORMATION | | | ATTRIBUTE INFORMATION | | |
| | POSITION | SPEED | ··· | | | ··· |
| | | | | | | |
| | | | | | | |
| | | | | | | |

FIG. 12

ALERT OF OCCURRENCE OF PRE-DANGEROUS STATE OF VEHICLE

This application is a National Stage Entry of PCT/JP2018/034166 filed on Sep. 14, 2018, which is based upon and claims the benefit of priority from Japanese patent application No. 2018-146729, filed on Aug. 3, 2018, the disclosure of which is incorporated herein in its entirety by reference.

TECHNICAL FIELD

The present invention relates to an information processing apparatus, an information processing method, and an information processing program.

BACKGROUND ART

In the above technical field, patent literature 1 discloses a technique of determining the presence/absence of danger of collision based on the calculation result of the relative position between a moving body and a self-vehicle, and making, if the presence of danger of collision is determined, a notification of danger of collision.

CITATION LIST

Patent Literature

Patent literature 1: Japanese Patent Laid-Open No. 2017-174449

SUMMARY OF THE INVENTION

Technical Problem

In the technique described in the above literature, however, it is impossible to alert the driver of a vehicle to occurrence of various pre-dangerous states.

The present invention provides a technique of solving the above-described problem.

Solution to Problem

One example aspect of the present invention provides an information processing apparatus comprising:

a storage unit that stores information obtained by a traveling simulation of a vehicle in a virtual environment and indicating a pre-dangerous state before the vehicle is set in a dangerous state;

a first acquirer that acquires actual information during traveling of the vehicle; and an alert controller that provides an alert of occurrence of the pre-dangerous state based on the actual information acquired by the first acquirer and the information indicating the pre-dangerous state.

Another example aspect of the present invention provides an information processing method comprising:

acquiring actual information during traveling of a vehicle; and providing an alert of occurrence of a pre-dangerous state based on the actual information acquired in the acquiring and information obtained by a traveling simulation of the vehicle in a virtual environment and indicating the pre-dangerous state which is before the vehicle is set in a dangerous state and is stored in a storage unit.

Still other example aspect of the present invention provides an information processing program for causing a computer to execute a method, comprising:

acquiring actual information during traveling of a vehicle; and providing an alert of occurrence of a pre-dangerous state based on the actual information acquired in the acquiring and information obtained by a traveling simulation of the vehicle in a virtual environment and indicating the pre-dangerous state which is before the vehicle is set in a dangerous state and is stored in a storage unit.

Advantageous Effects of Invention

According to the present invention, it is possible to alert the driver of a vehicle to occurrence of various pre-dangerous states.

BRIEF DESCRIPTION OF DRAWINGS

FIG. 4A is a table showing an example of a determination table provided in the information processing apparatus according to the second example embodiment of the present invention;

FIG. 4B is a table showing an example of an alert table provided in the information processing apparatus according to the second example embodiment of the present invention;

FIG. 8 is a table showing an example of an inter-vehicle communication information table provided in the information processing apparatus according to the third example embodiment of the present invention;

FIG. 12 is a table showing an example of an attribute table provided in the information processing apparatus according to the fourth example embodiment of the present invention;

DESCRIPTION OF EXAMPLE EMBODIMENTS

Example embodiments of the present invention will now be described in detail with reference to the drawings. It should be noted that the relative arrangement of the components, the numerical expressions and numerical values set forth in these example embodiments do not limit the scope of the present invention unless it is specifically stated otherwise.

First Example Embodiment

An information processing apparatus 100 according to the first example embodiment of the present invention will be described with reference to FIG. 1. The information processing apparatus 100 is an apparatus that alerts the driver of a vehicle to occurrence of a pre-dangerous state.

Figure 1:
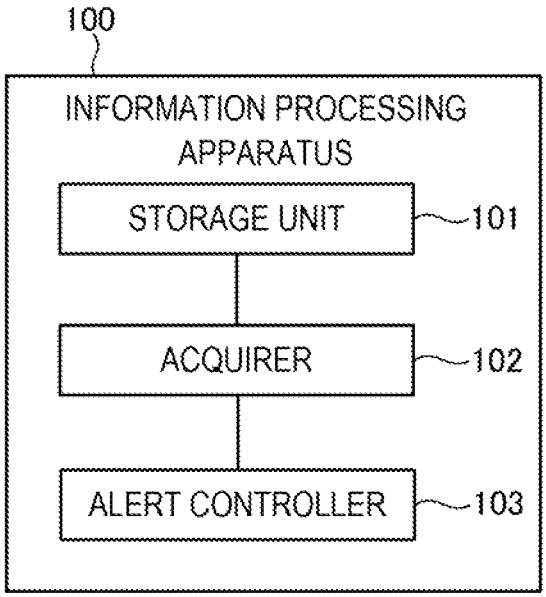
FIG. 1 is a block diagram showing the arrangement of an information processing apparatus according to the first example embodiment of the present invention.

As shown in FIG. 1, the information processing apparatus 100 includes a storage unit 101, an acquirer 102, and an alert controller 103. The storage unit 101 stores information obtained by a traveling simulation of a vehicle in a virtual environment and indicating a pre-dangerous state before the vehicle is set in a dangerous state. The acquirer 102 acquires actual information during traveling of the vehicle. The alert controller 103 provides an alert of occurrence of a dangerous state based on the actual information acquired by the acquirer 102 and the information indicating the pre-dangerous state.

According to this example embodiment, it is possible to alert the driver of a vehicle to occurrence of various pre-dangerous states.

Second Example Embodiment

Figure 2A:
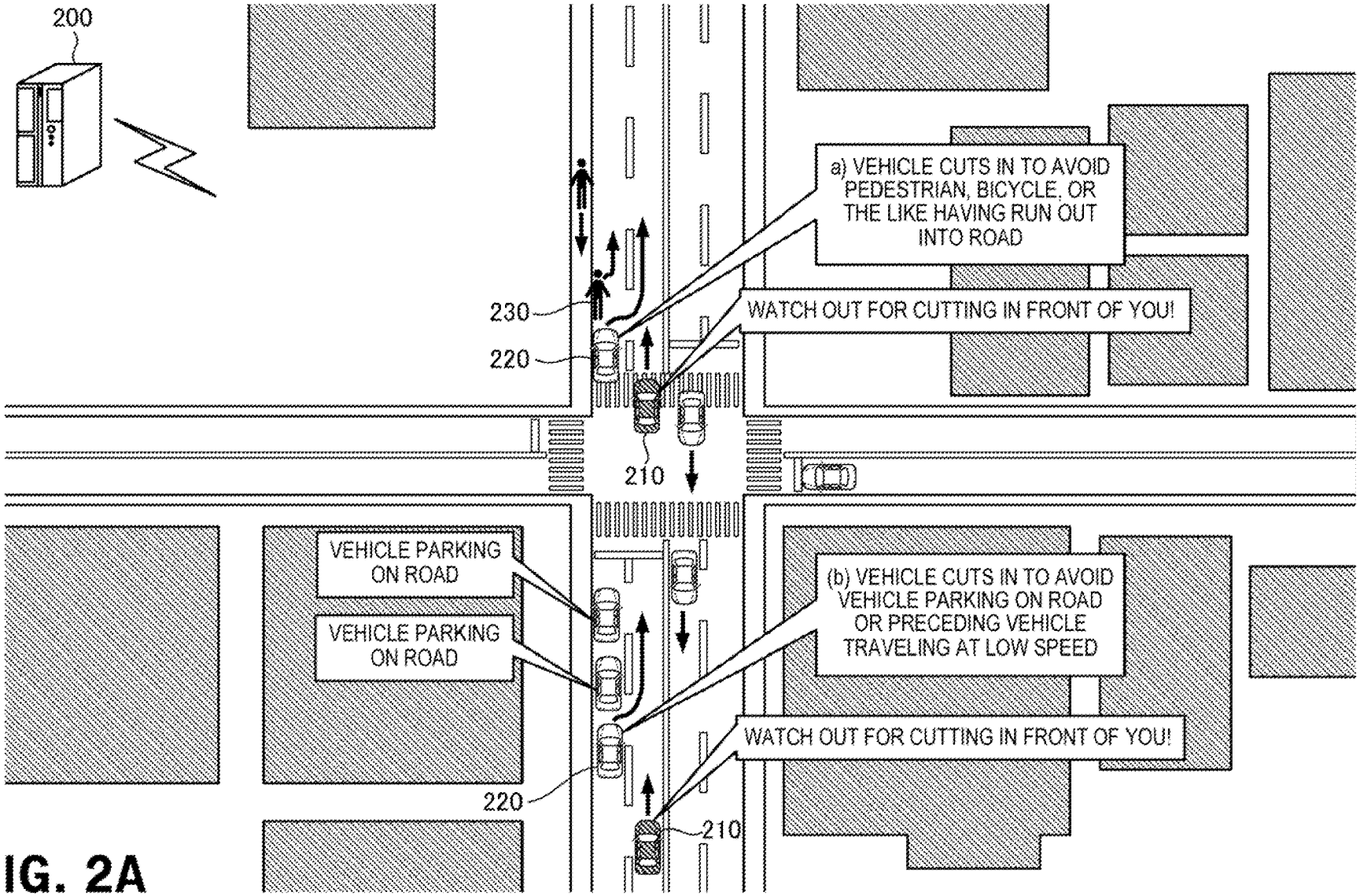
FIG. 2A is a view for explaining an example of output of an alert by an information processing apparatus according to the second example embodiment of the present invention.

An information processing apparatus 200 according to the second example embodiment of the present invention will be described next with reference to FIGS. 2A to 6. FIG. 2A is a view for explaining an example of output of an alert by the information processing apparatus 200 according to this example embodiment.

In (a) of FIG. 2A, a vehicle 220 traveling on the front left side of a vehicle 210 turns a steering wheel to the right to avoid a bicycle or a pedestrian 230 having run out into a road. This means that the vehicle 220 cuts in a lane on which the vehicle 210 currently travels. If an avoidance action of the vehicle 210 is delayed or inappropriate, a dangerous state in which the vehicle 210 bumps into the vehicle 220 occurs. That is, in this scene, if the vehicle 220 performs an avoidance action, the vehicle 210 is set in a pre-dangerous state before the dangerous state.

The information processing apparatus 200 stores such pre-dangerous state. The pre-dangerous state stored in the information processing apparatus 200 is obtained by a traveling simulation of the vehicle 210 in a virtual environment.

The information processing apparatus 200 controls output of an alert by comparing actual information acquired from the vehicle 210 during traveling with information indicating the stored pre-dangerous state. Then, if the information processing apparatus 200 determines, as a result of comparison, that the vehicle 210 is in the pre-dangerous state, the information processing apparatus 200 controls output of an alert, thereby outputting the alert to the vehicle 210. The actual information includes, for example, the vehicle speed of the vehicle, an acceleration, and a distance to a preceding vehicle, and a moving image or a still image captured by a front camera or the like.

As an alert to be output, for example, the information processing apparatus 200 outputs a voice "watch out for cutting in front of you!" from the loudspeaker of the vehicle 210 or displays a message on a display provided in the vehicle 210. Since the vehicle 220 on the front left side cuts in front of the vehicle 210, the information processing apparatus 200 may control to output the alert from the loudspeaker provided on the front left side of the vehicle 210. This allows the driver of the vehicle 210 to know that the vehicle 210 is in the pre-dangerous state, and he/she can thus reliably avoid the dangerous state.

In (b) of FIG. 2A, there are vehicles parking on the road ahead of the vehicle 220 traveling on the front left side of the vehicle 210, and the vehicle 220 thus turns the steering wheel to the right to avoid the vehicles parking on the road. This means that the vehicle 220 cuts in a lane on which the vehicle 210 currently travels. In this case as well, the information processing apparatus 200 controls output of an alert by comparing actual information acquired from the vehicle 210 during traveling with information indicating the stored pre-dangerous state. If the information processing apparatus 200 determines, as a result of comparison, that the vehicle 210 is in the pre-dangerous state, the information processing apparatus 200 controls output of an alert, thereby outputting the alert to the vehicle 210. As an alert to be output, for example, the information processing apparatus 200 outputs a voice "watch out for cutting in front of you!" from the loudspeaker of the vehicle 210 or the like. This allows the driver of the vehicle 210 to know that the vehicle 210 is in the pre-dangerous state, and he/she can thus reliably avoid the dangerous state.

Figure 2B:
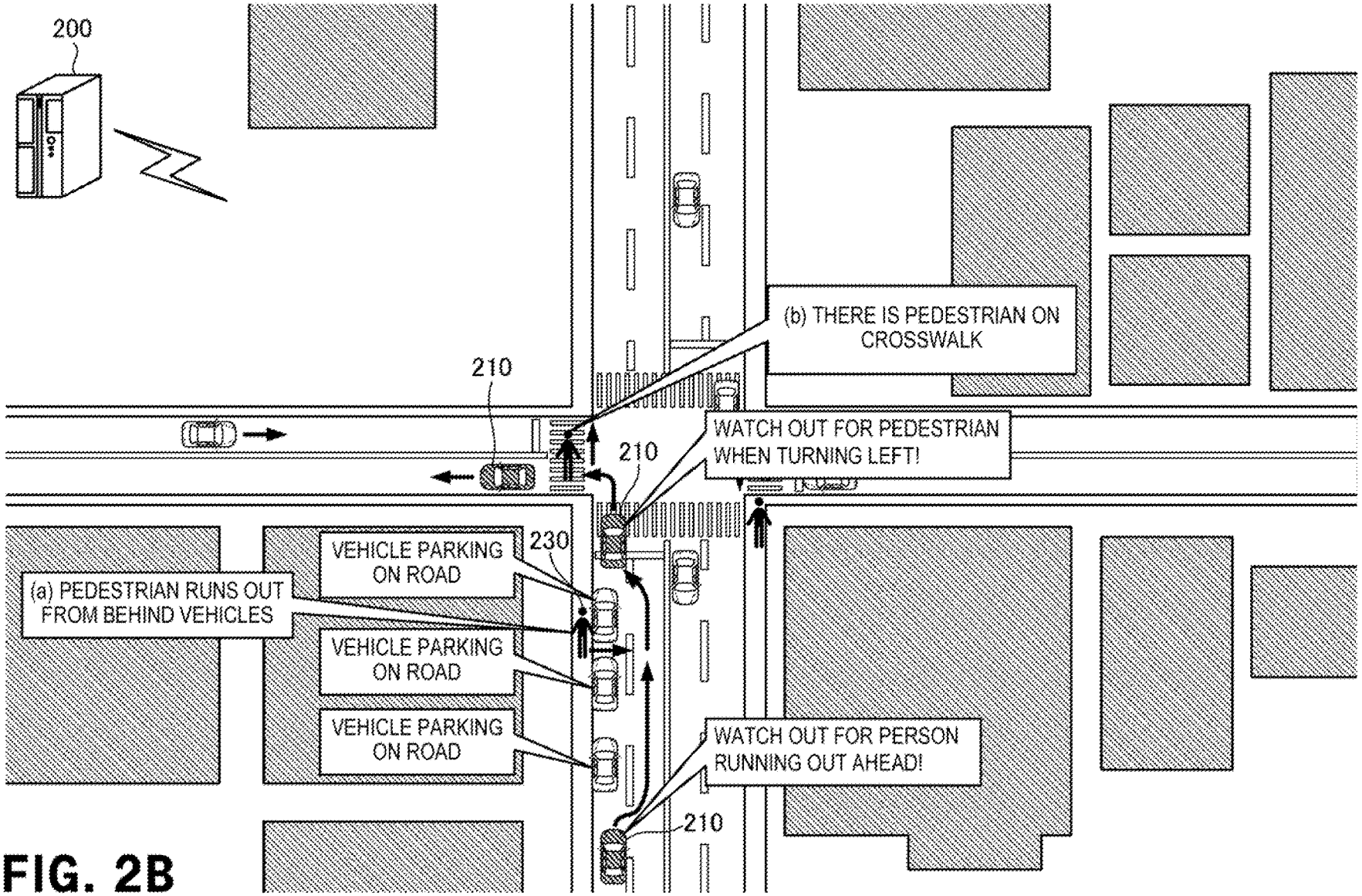
FIG. 2B is a view for explaining another example of output of an alert by the information processing apparatus according to the second example embodiment of the present invention.

FIG. 2B is a view for explaining another example of output of an alert by the information processing apparatus 200 according to this example embodiment. In FIG. 2B, (a) shows a scene in which the pedestrian 230 runs out in the front of the vehicle 210 from an area between vehicles parking on the road. The information processing apparatus 200 compares actual information acquired from the vehicle 210 with information indicating the pre-dangerous state stored in the storage unit. If it is determined that the vehicle 210 is in the pre-dangerous state (the pre-dangerous state has occurred in the vehicle 210), the information processing apparatus 200 controls output of an alert corresponding to the pre-dangerous state. As an alert to be output, for example, the information processing apparatus 200 outputs a voice "watch out for a person running out ahead!" from the loudspeaker of the vehicle 210 or the like. This allows the driver of the vehicle 210 to know that the vehicle 210 is in the pre-dangerous state, and he/she can thus reliably avoid the dangerous state.

As shown in (a) of FIG. 2B, if the vehicle 210 changes the lane in a state in which the driver of the vehicle 210 cannot recognize the existence of the pedestrian 230 being behind the vehicles parking on the road, the attention of the driver of the vehicle 210 may be caught by the lane change and the driver may be late in finding the pedestrian 230, thereby setting the vehicle 210 in the pre-dangerous state. In this case, the information processing apparatus 200 outputs an alert, and notifies the driver of the vehicle 210 of the pre-dangerous state. As an alert to be output, for example, the information processing apparatus 200 outputs an alert "watch out for a person running out ahead!" to the vehicle 210. This allows the driver of the vehicle 210 to know that the vehicle 210 is in the pre-dangerous state, and he/she can thus reliably avoid the dangerous state.

In FIG. 2B, (b) shows a scene in which there is a pedestrian crossing a crosswalk after the vehicle 210 turns left at an intersection. If, for example, a pedestrian, a motorcycle, a bicycle, or the like is in the blind spot of the vehicle 210 and the driver of the vehicle 210 is late in finding the pedestrian or the like, a dangerous state in which the vehicle 210 collides with the pedestrian or the like may unwantedly be set. The information processing apparatus 200 compares actual information acquired from the vehicle 210 with information indicating the pre-dangerous state stored in the storage unit. If it is determined that the vehicle 210 is in the pre-dangerous state (the pre-dangerous state has occurred in the vehicle 210), the information processing apparatus 200 controls output of an alert corresponding to the pre-dangerous state.

As shown in (b) of FIG. 2B, the vehicle 210 may collide with the pedestrian or hit the motorcycle or bicycle which tries to pass the vehicle 210 on the left side and the vehicle 210 is thus set in the pre-dangerous state, the information processing apparatus 200 controls output of an alert to the vehicle 210. As an alert to be output, for example, the information processing apparatus 200 outputs an alert "watch out for a pedestrian when turning left!" or "watch out not to hit a pedestrian when turning left!" to the vehicle 210. This allows the driver of the vehicle 210 to know that the vehicle 210 is in the pre-dangerous state, and he/she can thus reliably avoid the dangerous state.

Furthermore, if there is the pedestrian crossing the crosswalk on the front left side of the vehicle 210, the information processing apparatus 200 controls to output an alert from, for example, a loudspeaker attached to the front left side inside the vehicle 210. Similarly, if a motorcycle or a bicycle is approaching from the rear left side of the vehicle 210, the information processing apparatus 200 may control to output an alert from a loudspeaker attached to the rear left side inside the vehicle 210.

Figure 2C:
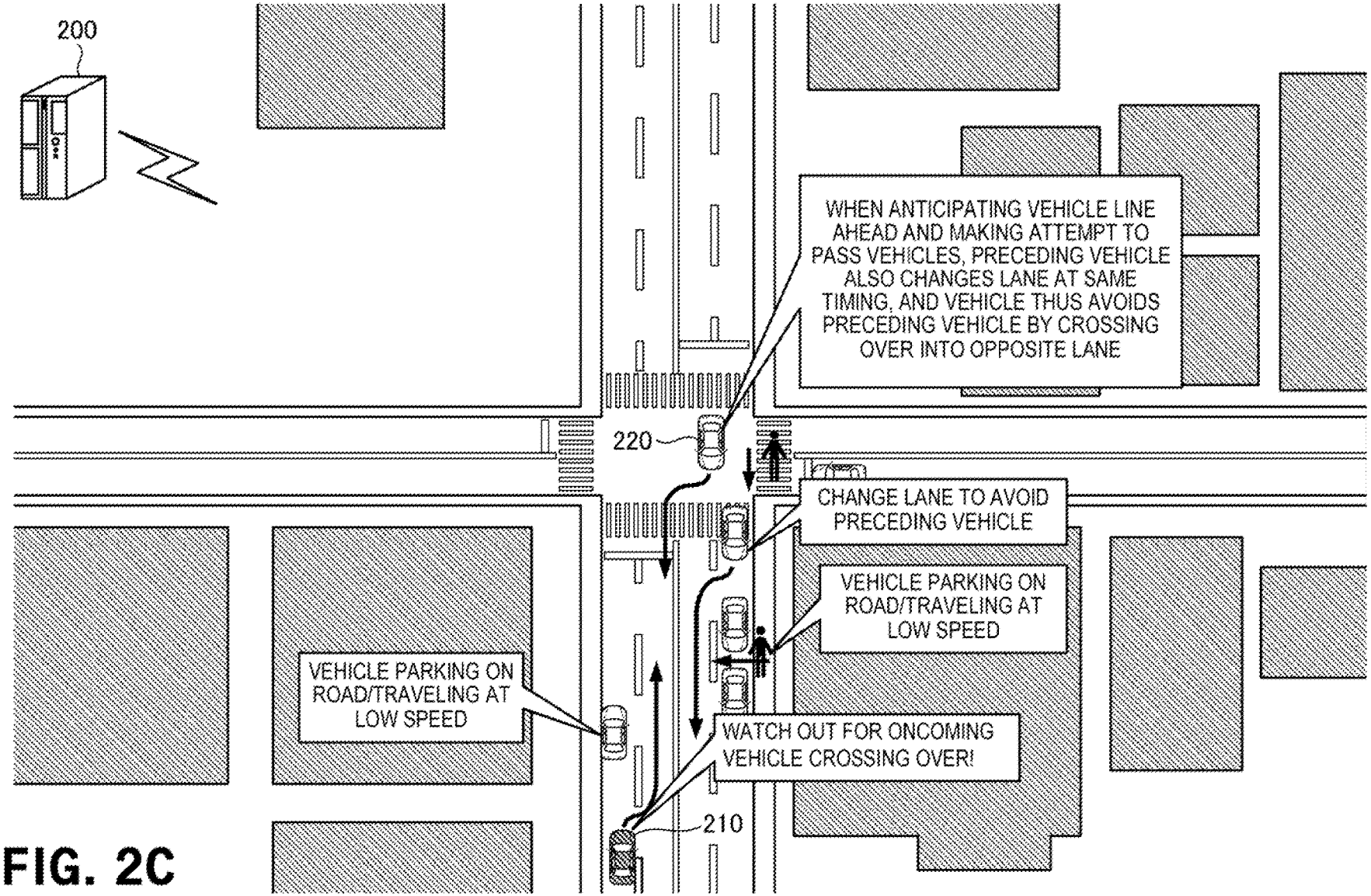
FIG. 2C is a view for explaining still other example of output of an alert by the information processing apparatus according to the second example embodiment of the present invention.

FIG. 2C is a view for explaining still other example of output of an alert by the information processing apparatus 200 according to this example embodiment. FIG. 2C shows a scene in which an oncoming vehicle crosses over in front of the vehicle 210. When the vehicle 220 traveling on the opposite lane anticipates a vehicle line ahead and makes an attempt to change the lane and pass the vehicles, a preceding vehicle also changes the lane at the same timing. Therefore, the course of the vehicle 220 is blocked. To avoid this, the vehicle 220 further changes the lane to cross over into the opposite lane.

Then, there is a vehicle, which is parking on the road or traveling at low speed, ahead of the vehicle 210, and thus the vehicle 210 is to change the lane at the same timing as that of the vehicle 220 to avoid the vehicle. However, if the vehicle 210 changes the lane, it may collide head-on with the vehicle 220. The information processing apparatus 200 compares actual information acquired from the vehicle 210 with information indicating the pre-dangerous state stored in the storage unit. If it is determined that the vehicle 210 is in the pre-dangerous state (the pre-dangerous state has occurred in the vehicle 210), the information processing apparatus 200 controls output of an alert corresponding to the pre-dangerous state. In this case, as an alert, for example, the information processing apparatus 200 outputs an alert "watch out for an oncoming vehicle crossing over!" to the vehicle 210. This allows the driver of the vehicle 210 to know that the vehicle 210 is in the pre-dangerous state, and he/she can thus reliably avoid the dangerous state.

Figure 2D:
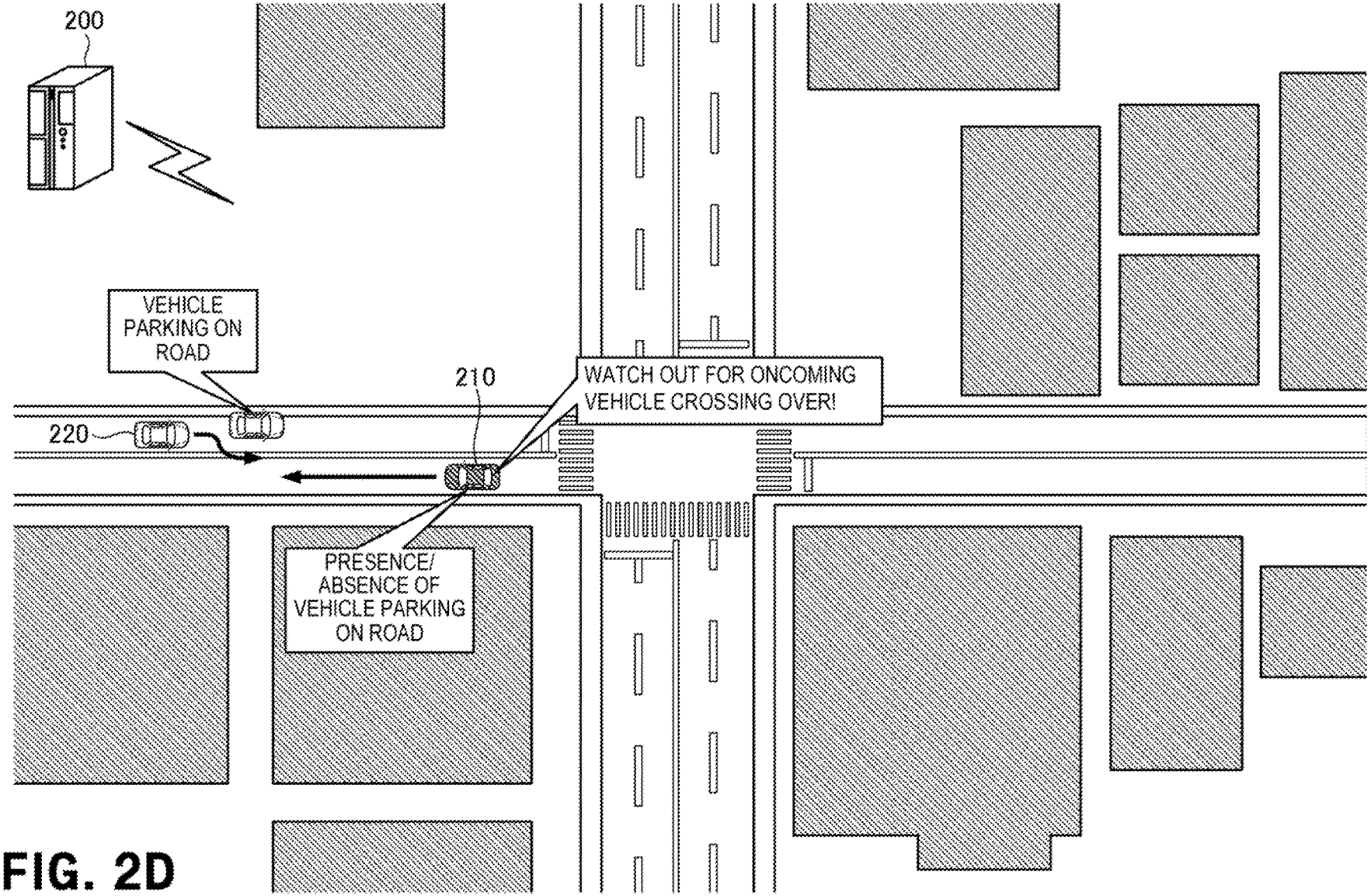
FIG. 2D is a view for explaining still other example of output of an alert by the information processing apparatus according to the second example embodiment of the present invention.

FIG. 2D is a view for explaining still other example of output of an alert by the information processing apparatus 200 according to this example embodiment. FIG. 2D shows a scene in which an oncoming vehicle crosses over in front of the vehicle 210. On a single-lane road, the vehicle 220 in the opposite lane crosses over into the lane, on which the vehicle 210 currently travels, in order to pass a vehicle parking on the road.

Therefore, the information processing apparatus 200 compares actual information acquired from the vehicle 210 with information indicating the pre-dangerous state stored in the storage unit. If it is determined that the vehicle 210 is in the pre-dangerous state (the pre-dangerous state has occurred in the vehicle 210), the information processing apparatus 200 controls output of an alert corresponding to the pre-dangerous state. In this case, as an alert, for example, the information processing apparatus 200 outputs an alert "watch out for an oncoming vehicle crossing over!" to the vehicle 210. In this case, since the oncoming vehicle 220 crosses over from the front right side of the vehicle 210, the information processing apparatus 200 controls to output the alert from a lamp or loudspeaker provided at the front right position inside the vehicle 210.

Figure 2E:
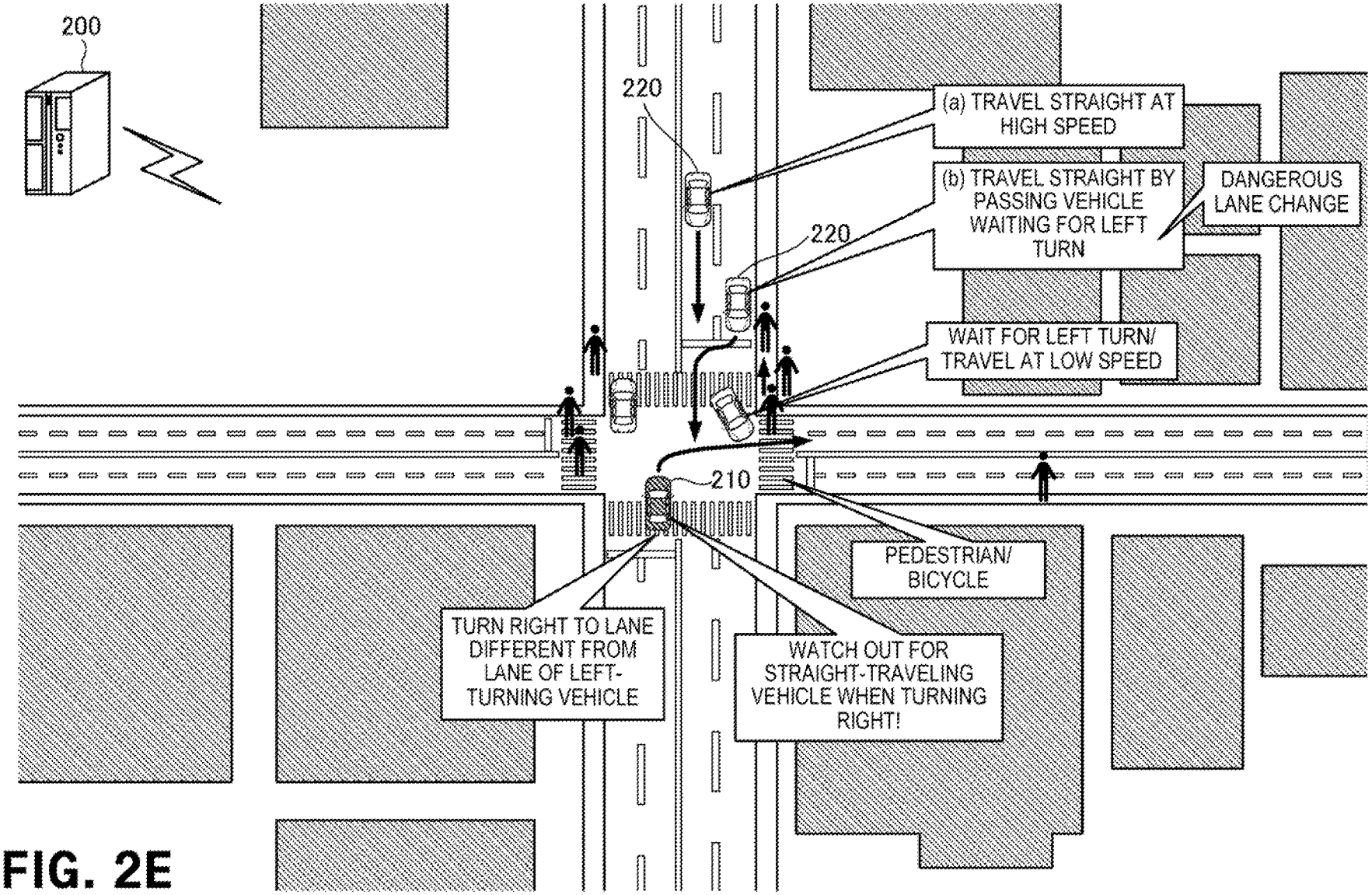
FIG. 2E is a view for explaining still other example of output of an alert by the information processing apparatus according to the second example embodiment of the present invention.

FIG. 2E is a view for explaining still other example of output of an alert by the information processing apparatus 200 according to this example embodiment. FIG. 2E shows a scene in which a straight-traveling oncoming vehicle approaches when the vehicle 210 turns right. In (a) of FIG. 2E, in a scene in which the vehicle 210 is to turn right, the vehicle 220 traveling straight in an opposite lane at high speed approaches. The information processing apparatus 200 compares actual information such as a video of a front camera acquired from the vehicle 210 with information indicating the pre-dangerous state stored in the storage unit. If it is determined that the vehicle 210 is in the pre-dangerous state (the pre-dangerous state has occurred in the vehicle 210), the information processing apparatus 200 controls output of an alert corresponding to the pre-dangerous state. In this case, as an alert, for example, the information processing apparatus 200 outputs an alert "watch out for a straight-traveling vehicle when turning right!" to the vehicle 210.

In (b) of FIG. 2E, in a scene in which the vehicle 210 is to turn right, the vehicle 220 is to change the lane to pass a vehicle (low-speed vehicle) waiting for a left turn from behind the vehicle waiting for a left turn on the front right side of the vehicle 210. The information processing apparatus 200 compares actual information such as a video of the front camera acquired from the vehicle 210 with information indicating the pre-dangerous state stored in the storage unit. If it is determined that the vehicle 210 is in the pre-dangerous state (the pre-dangerous state has occurred in the vehicle 210), the information processing apparatus 200 controls output of an alert corresponding to the pre-dangerous state. In this case, as an alert, for example, the information processing apparatus 200 outputs an alert "watch out for a straight-traveling vehicle when turning right!" to the vehicle 210.

Figure 2F:
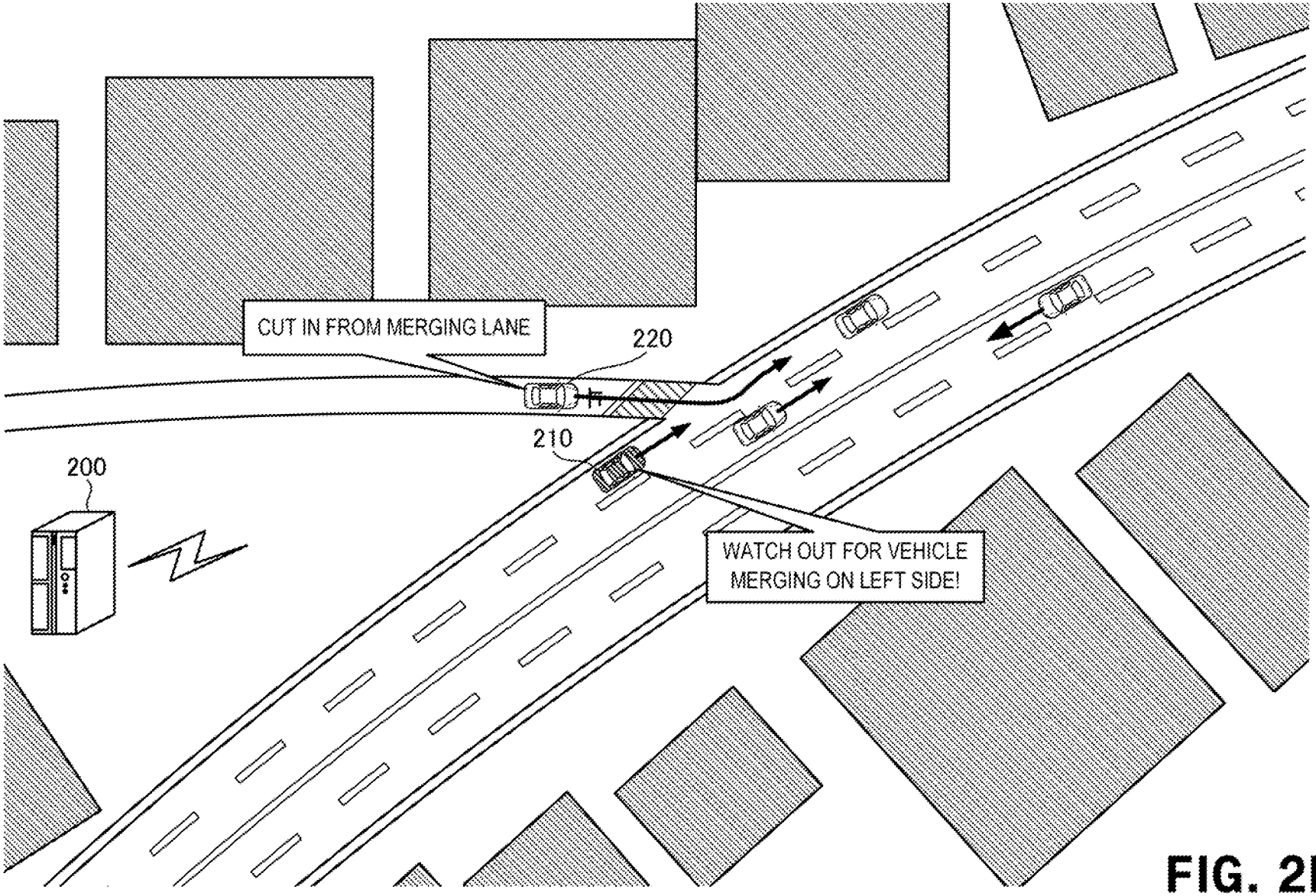
FIG. 2F is a view for explaining still other example of output of an alert by the information processing apparatus according to the second example embodiment of the present invention.

FIG. 2F is a view for explaining still other example of output of an alert by the information processing apparatus 200 according to this example embodiment. FIG. 2F shows a scene in which another vehicle cuts in front of the vehicle 210 from a merging lane. While the vehicle 210 travels in the main lane of a road, for example, the driver of the vehicle 220 misjudges the distance to the vehicle 210, and is to merge by cutting in just front of the vehicle 210. The information processing apparatus 200 compares actual information such as a video of the front camera acquired from the vehicle 210 with information indicating the pre-dangerous state stored in the storage unit. If it is determined that the vehicle 210 is in the pre-dangerous state (the pre-dangerous state has occurred in the vehicle 210), the information processing apparatus 200 controls output of an alert corresponding to the pre-dangerous state. In this case, as an alert, for example, the information processing apparatus 200 outputs an alert "watch out for merging on the left side!" to the vehicle 210. Then, since the vehicle 220 is to merge from the front left side of the vehicle 210, the information processing apparatus 200 may control to output the alert from a loudspeaker attached to the front left side inside the vehicle 210 or the like.

Figure 2G:
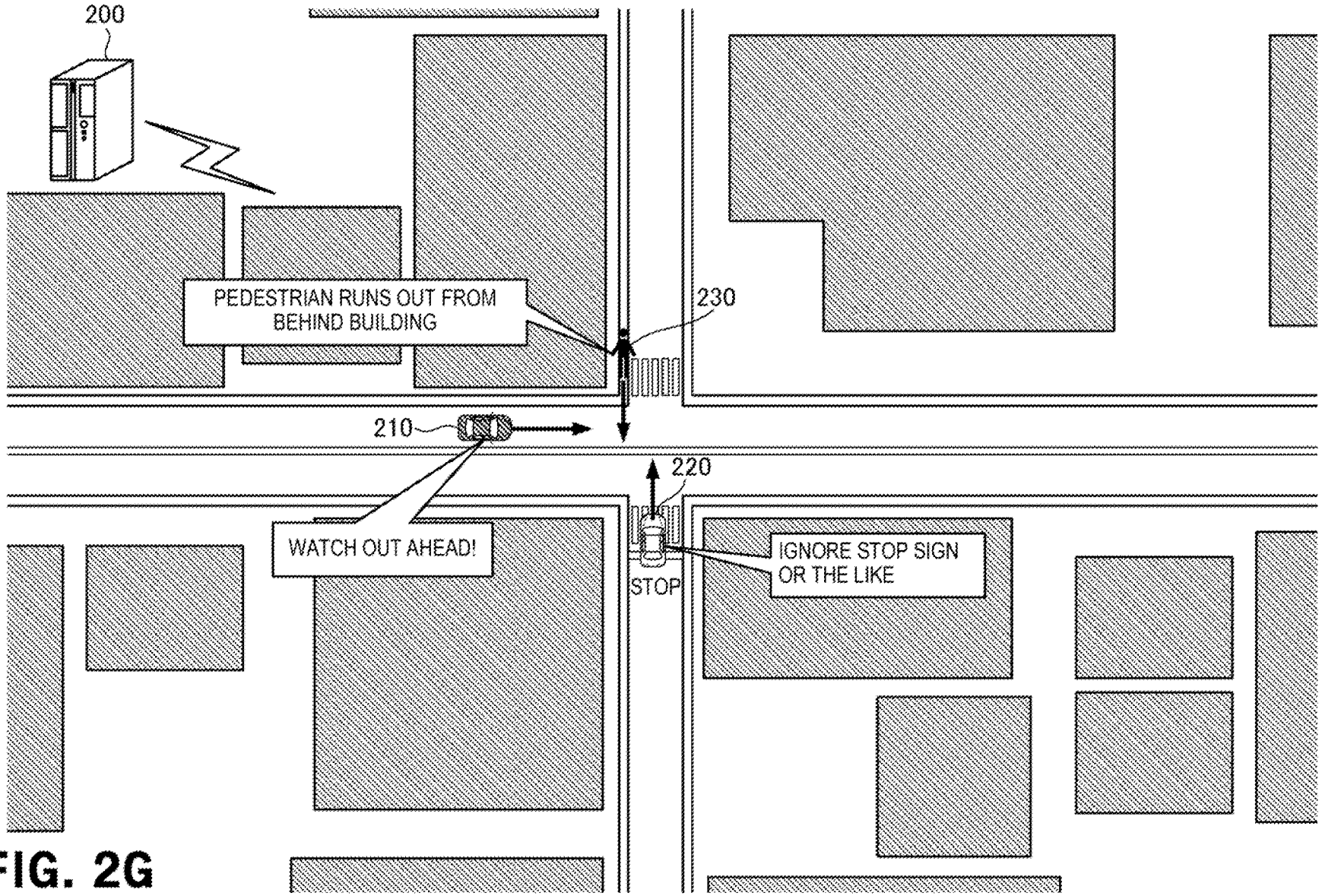
FIG. 2G is a view for explaining still other example of output of an alert by the information processing apparatus according to the second example embodiment of the present invention.

FIG. 2G is a view for explaining still other example of output of an alert by the information processing apparatus according to this example embodiment. FIG. 2G shows a scene in which at an intersection, a pedestrian or a vehicle runs out in front of the vehicle 210 from a blind spot. Referring to FIG. 2G, the vehicle 220 runs out by ignoring a stop sign from the frontage road ahead of the vehicle 210 during traveling or the pedestrian 230 runs out from behind a building. The information processing apparatus 200 compares actual information such as a video of the front camera acquired from the vehicle 210 with information indicating the pre-dangerous state stored in the storage unit. If it is determined that the vehicle 210 is in the pre-dangerous state (the pre-dangerous state has occurred in the vehicle 210), the information processing apparatus 200 controls output of an alert corresponding to the pre-dangerous state. In this case, as an alert, for example, the information processing apparatus 200 outputs an alert "watch out ahead!" to the vehicle 210.

Figure 3:
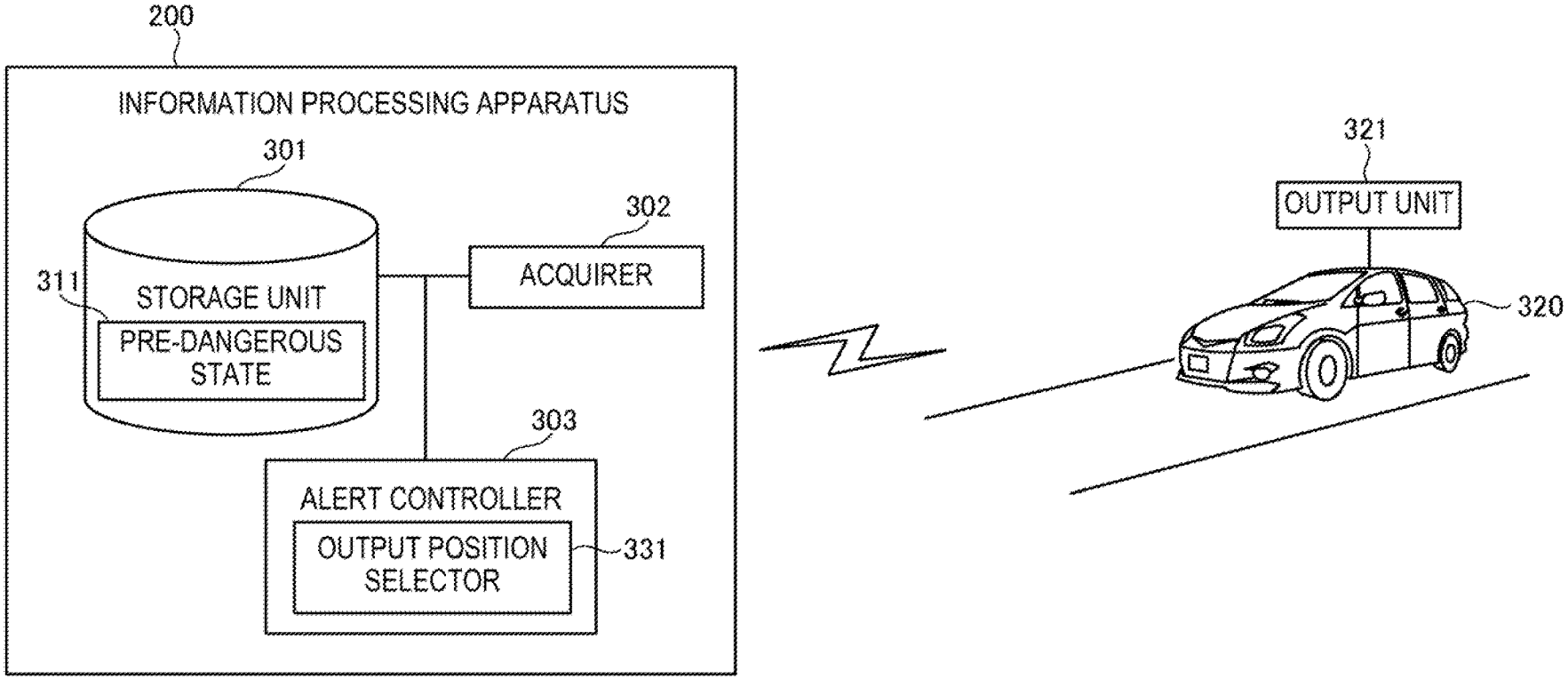
FIG. 3 is a block diagram showing the arrangement of the information processing apparatus according to the second example embodiment of the present invention.

FIG. 3 is a block diagram showing the arrangement of the information processing apparatus according to this example embodiment. The information processing apparatus 200 includes a storage unit 301, an acquirer 302, and an alert controller 303.

The storage unit 301 stores information indicating a pre-dangerous state 311. The information indicating the pre-dangerous state 311 is, for example, information obtained using a vehicle traveling simulator that simulates traveling of a vehicle 320 and a traveling environment simulator that simulates the traveling environment of the vehicle 320 in a virtual environment. The information indicating the pre-dangerous state 311 stored in the storage unit 301 also includes information processed by a neural network or the like.

The information processing apparatus 200 provides, to the vehicle traveling simulator, traveling parameters necessary to simulate traveling of the vehicle 320, and provides traveling environment parameters to the traveling environment simulator. Upon receiving the provided traveling parameters and traveling environment parameters from the information processing apparatus 200, the vehicle traveling simulator and the traveling environment simulator simulate traveling of the vehicle using the provided parameters. Simulation results are provided to the information processing apparatus 200.

The information processing apparatus 200 variously changes the traveling parameters and traveling environment parameters to be provided to the simulators, and provides them. This allows the information processing apparatus 200 to obtain simulation results in various situations from the simulators.

Upon receiving the provided simulation results, the information processing apparatus 200 detects, from the simulation results, occurrence of a dangerous state as a state dangerous for the vehicle 320. The state dangerous for the vehicle 320 is, for example, a traffic accident. Then, upon detecting the dangerous state, the information processing apparatus 200 changes the parameters, mainly the traveling parameters and traveling environment parameters which have caused the dangerous state. This allows the information processing apparatus 200 to store the information indicating the pre-dangerous states 311 of various patterns.

Based on the detected dangerous state, the information processing apparatus 200 stores information indicating the pre-dangerous state 311 before the vehicle 320 is set in the dangerous state. For example, for a video, the pre-dangerous state 311 corresponds to a state a predetermined number of frames or a predetermined time before the dangerous state. If the dangerous state is a traffic accident, the information processing apparatus 200 stores a state (preliminary state) before the accident occurs. The data stored in the information processing apparatus 200 is, for example, data concerning traveling of the vehicle 320 such as a video of the front camera of the vehicle 320 in the pre-dangerous state, the speed and acceleration of the vehicle 320 in the pre-dangerous state, and the rudder angle of the steering wheel but is not limited to them.

If the stored information indicating the pre-dangerous state 311 is a video, the information processing apparatus 200 stores a video a predetermined time before the dangerous state, a video a predetermined number of frames before the dangerous state, or traveling data of the vehicle 320 concerning the video. Note that the vehicle traveling simulator and the traveling environment simulator may be operated at the same time on one platform or operated separately to finally integrate simulation results.

The pre-dangerous state 311 includes at least one of cut-in of another vehicle in front of the vehicle 320, the lane change of the vehicle 320, and running-out of a person from the blind spot of the vehicle 320 (the driver thereof). Note that the pre-dangerous state 311 is not limited to them.

The acquirer 302 acquires, from the vehicle 320, actual information during traveling of the vehicle 320. The actual information during traveling includes, for example, a moving image or a still image of the front camera mounted on the vehicle 320, and information obtained from an ECU (Electrical Control Unit/Engine Control Unit) or an OBD2 (On Board Diagnosis second generation) mounted on the vehicle 320. Note that the information included in the actual information is not limited to them, and any information that can be acquired from the vehicle 320 may be included. The acquirer 302 acquires the actual information from the vehicle 320 by, for example, wireless communication via the Internet, but may acquire the actual information by short-distance wireless communication such as NFC (Near Field Communication) or another wireless communication method.

The alert controller 303 controls output of an alert based on comparison between the actual information acquired by the acquirer 302 and the information indicating the pre-dangerous state 311 accumulated in the storage unit 301. If, as a result of comparison between the actual information and the information indicating the pre-dangerous state 311, the alert controller 303 determines that the vehicle 320 is in the pre-dangerous state 311, it controls output of an alert corresponding to the type of the pre-dangerous state 311. If, for example, the pre-dangerous state 311 is cutting in front of the vehicle 320, the alert controller 303 outputs an alert that calls attention to the front.

In the comparison method by the alert controller 303, for example, it is determined whether the vehicle 320 is in the pre-dangerous state 311 by a method of comparing the feature point of the video acquired as the actual information with that of the stored video of the pre-dangerous state 311. That is, the alert controller 303 determines whether the vehicle 320 is in the pre-dangerous state 311, based on a result of performing calculation processing based on the information indicating the pre-dangerous state 311 stored in the storage unit 301 and the actual information during traveling of the vehicle 320 acquired by the acquirer 302. Note that the comparison method by the alert controller 303 is not limited to this. Furthermore, when comparing the actual information with the information indicating the pre-dangerous state 311, if the pre-dangerous state 311 continues for a predetermined time in the actual information, the alert controller 303 may determine that the vehicle 320 is in the pre-dangerous state 311. For example, when performing comparison using the acquired video or the like as the actual information of the vehicle 320, if the pre-dangerous state 311 continues for a predetermined number of frames (predetermined time), the alert controller 303 may control to output an alert.

If the state corresponds to the pre-dangerous state 311 instantaneously but the pre-dangerous state 311 disappears within a short period, the possibility of occurrence of the dangerous state is low. In this case, therefore, the alert controller 303 controls not to output an alert. With this control processing, it is possible to reduce useless output of an alert. When a dangerous state in which the driver should really be careful occurs, it is possible to reliably output an alert.

An output position selector 331 controls to select and output the output position, in the vehicle, of the alert corresponding to the type of the pre-dangerous state 311. If the pre-dangerous state 311 is cut-in of another vehicle in front of the vehicle 320, the output position selector 331 controls to select and output the front side of the driver of the vehicle 320 as the output position of the alert. If the pre-dangerous state 311 is the lane change of the vehicle 320, the output position selector 331 controls to select and output the direction of the blind spot of the vehicle 320 as the output position of the alert. If the pre-dangerous state 311 is running-out of a person from the blind spot of the vehicle 320, the output position selector 331 controls to select and output, as the output position of the alert, a direction from which the person runs out.

The vehicle 320 includes an output unit 321. The vehicle 320 may include a plurality of output units 321. The output unit 321 is, for example, a loudspeaker that outputs a sound, a light that output light, or a display that outputs a video and the like. However, the output unit 321 is not limited to them, and any unit that can output some alert to the driver may be used.

If the output unit 321 is a loudspeaker, the output unit 321 is attached to, for example, a pillar (A pillar, B pillar, or C pillar), windshield, side window, rear window, door, or rear-view mirror of the vehicle 320. Note that even if the output unit 321 is a light or a display, it may be attached to a position similar to that of the loudspeaker. The position to which the output unit 321 is attached is not limited to them. As the output unit 321, a vibrator that vibrates the steering wheel or seat of the vehicle 320 may be attached to the steering wheel or seat.

Then, the output position selector 331 selects the output destination of the alert in accordance with the pre-dangerous state 311. For example, if the pre-dangerous state 311 is cut-in of another vehicle in front of the vehicle 320, the pre-dangerous state 311 for the driver occurs in front of the vehicle 320. In this case, therefore, the output position selector 331 selects the output unit 321 attached to the front side inside the vehicle 320.

If another vehicle cuts in from the front left side of the vehicle 320, the output position selector 331 selects the output unit 321 such as the loudspeaker attached to the front left side inside the vehicle 320, for example, the A pillar on the left side. Similarly, if another vehicle cuts in from the front right side of the vehicle 320, the output position selector 331 selects the output unit 321 attached to the front right side inside the vehicle 320, for example, the A pillar on the right side.

The alert controller 303 may confirm (determine) the presence/absence of a failure of the output destination device (loudspeaker) or the like selected by the output position selector 331. Then, if, as a result of determination of the presence/absence of a failure, the presence of the failure is determined, the output position selector 331 reselects another device to replace the selected output destination device (failure device). The alert controller 303 outputs an alert to the driver from the device reselected by the output position selector 331 (notifies the driver of danger). If, for example, the loudspeaker on the rear left side fails, the output position selector 331 selects the loudspeaker on the front left side. The alert controller 303 outputs an alert from the selected loudspeaker on the front left side. In this case, the alert controller 303 may change contents (voice message or display message) of the alert to be output.

If another vehicle cuts in from the front right side of the vehicle 320, the output position selector 331 may vibrate the front right side in the vehicle 320, for example, the right side of the steering wheel, or vibrate the right side of the driver's seat.

FIG. 4A is a table showing an example of a determination table 401 provided in the information processing apparatus 200 according to this example embodiment. The determination table 401 stores actual information in association with a pre-dangerous state 411. The pre-dangerous state 411 includes "cut-in of another preceding vehicle", "lane change", and "running-out of person from blind spot", but is not limited to them. Actual information 412 includes the position and speed of the vehicle 320 acquired from the vehicle 320, and a video of the front camera or the like attached to the vehicle 320, but is not limited to them. With reference to the determination table 401, the information processing apparatus 200 determines whether the vehicle 320 is in the pre-dangerous state. If, for example, a neural network is used, parameters as a result of learning the pre-dangerous state are stored. Whether the vehicle 320 is in the pre-dangerous state (the pre-dangerous state has occurred) is determined using the stored parameters and a result of performing calculation processing for the actual information.

FIG. 4B is a table showing an example of an alert table 402 provided in the information processing apparatus 200 according to this example embodiment. The alert table 402 stores an alert 422 in association with the pre-dangerous state 411.

The alert 422 includes an alert such as a sound, light, or a vibration, but is not limited to them. Furthermore, for example, the alert 422 by a sound includes a position, a volume, and a timing where the position is associated with, for example, the position of the loudspeaker from which the sound is output, the volume is associated with, for example, a volume output from the loudspeaker, and the timing is associated with a timing at which the sound is output. Similarly, the alert 422 by light or a vibration includes a position, a cycle, and a timing. The alert controller 303 controls output of the alert with reference to the alert table 402.

Figure 5:
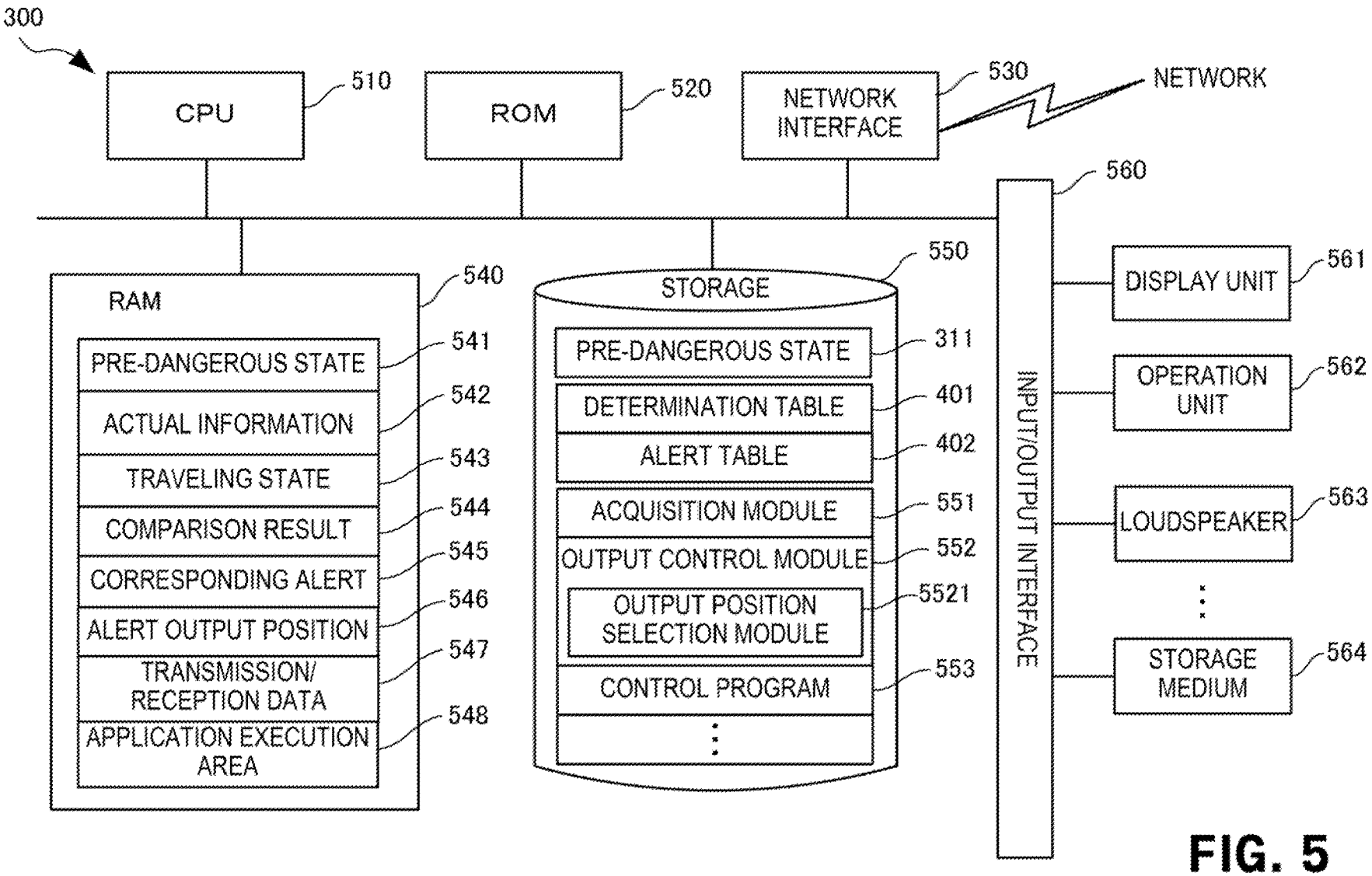
FIG. 5 is a block diagram for explaining the hardware arrangement of the information processing apparatus according to the second example embodiment of the present invention.

FIG. 5 is a block diagram for explaining the hardware arrangement of the information processing apparatus 200 according to this example embodiment. A CPU (Central Processing Unit) 510 is an arithmetic control processor, and implements the functional components of the information processing apparatus 200 shown in FIG. 3 by executing a program. The CPU 510 may include a plurality of processors to parallelly execute different programs, modules, tasks, or threads. A ROM (Read Only Memory) 520 stores permanent data such as initial data and a program, and other programs. A network interface 530 communicates with another apparatus or the like via a network. Note that the number of CPUs 510 is not limited to one, and a plurality of CPUs or a GPU (Graphics Processing Unit) for image processing may be included. The network interface 530 desirably includes a CPU independent of the CPU 510, and writes or reads transmission/reception data in or from the area of a RAM (Random Access Memory) 540. It is desirable to provide a DMAC (Direct Memory Access Controller) (not shown) for transferring data between the RAM 540 and a storage 550. Furthermore, the CPU 510 recognizes that data has been received by the RAM 540 or transferred to the RAM 540, and processes the data. The CPU 510 prepares a processing result in the RAM 540, and delegates succeeding transmission or transfer to the network interface 530 or the DMAC.

The RAM 540 is a random access memory used as a temporary storage work area by the CPU 510. An area to store data necessary for implementation of this example embodiment is allocated to the RAM 540. A pre-dangerous state 541 is data concerning the pre-dangerous state 311 stored in the storage unit 301. Actual information 542 includes a video of a front camera or the like acquired from the vehicle 320 during traveling and various data concerning traveling. A traveling state 543 is the state of the vehicle 320 derived from the actual information. A comparison result 544 is a result of comparison between the actual information of the vehicle 320 and the information indicating the pre-dangerous state 311. A corresponding alert 545 is an alert corresponding to the type of the pre-dangerous state 311 in which the vehicle 320 is set. An alert output position 546 is the output position of the alert selected by the alert controller 303.

Transmission/reception data 547 is data transmitted/received via the network interface 530. The RAM 540 includes an application execution area 548 for executing various application modules.

The storage 550 stores a database, various parameters, or the following data or programs necessary for implementation of this example embodiment. The storage 550 stores the pre-dangerous state 311 and the alert table 402. The alert table 402 is the table, shown in FIG. 4B, for managing the relationship between the pre-dangerous state and the alert.

The storage 550 also stores an acquisition module 551, an output control module 552, and an output position selection module 5521. The acquisition module 551 is a module that acquires the actual information during traveling of the vehicle 320. The output control module 552 is a module that controls output of an alert based on comparison between the acquired actual information and the information indicating the pre-dangerous state 311. The output position selection module 5521 is a module that controls to select and output an output position, in the vehicle, of the alert corresponding to the type of the pre-dangerous state 311. These modules 551, 552, and 5521 are read out by the CPU 510 into the application execution area 548 of the RAM 540, and executed. A control program 553 is a program for controlling the whole information processing apparatus 200.

An input/output interface 560 interfaces input/output data with an input/output device. The input/output interface 560 is connected to a display unit 561 and an operation unit 562. In addition, a storage medium 564 may be connected to the input/output interface 560. A loudspeaker 563 serving as a voice output unit, a microphone (not shown) serving as a voice input unit, or a GPS position determiner may also be connected. Note that programs and data which are associated with the general-purpose functions of the information processing apparatus 200 and other feasible functions are not shown in the RAM 540 or the storage 550 of FIG. 5.

Figure 6:
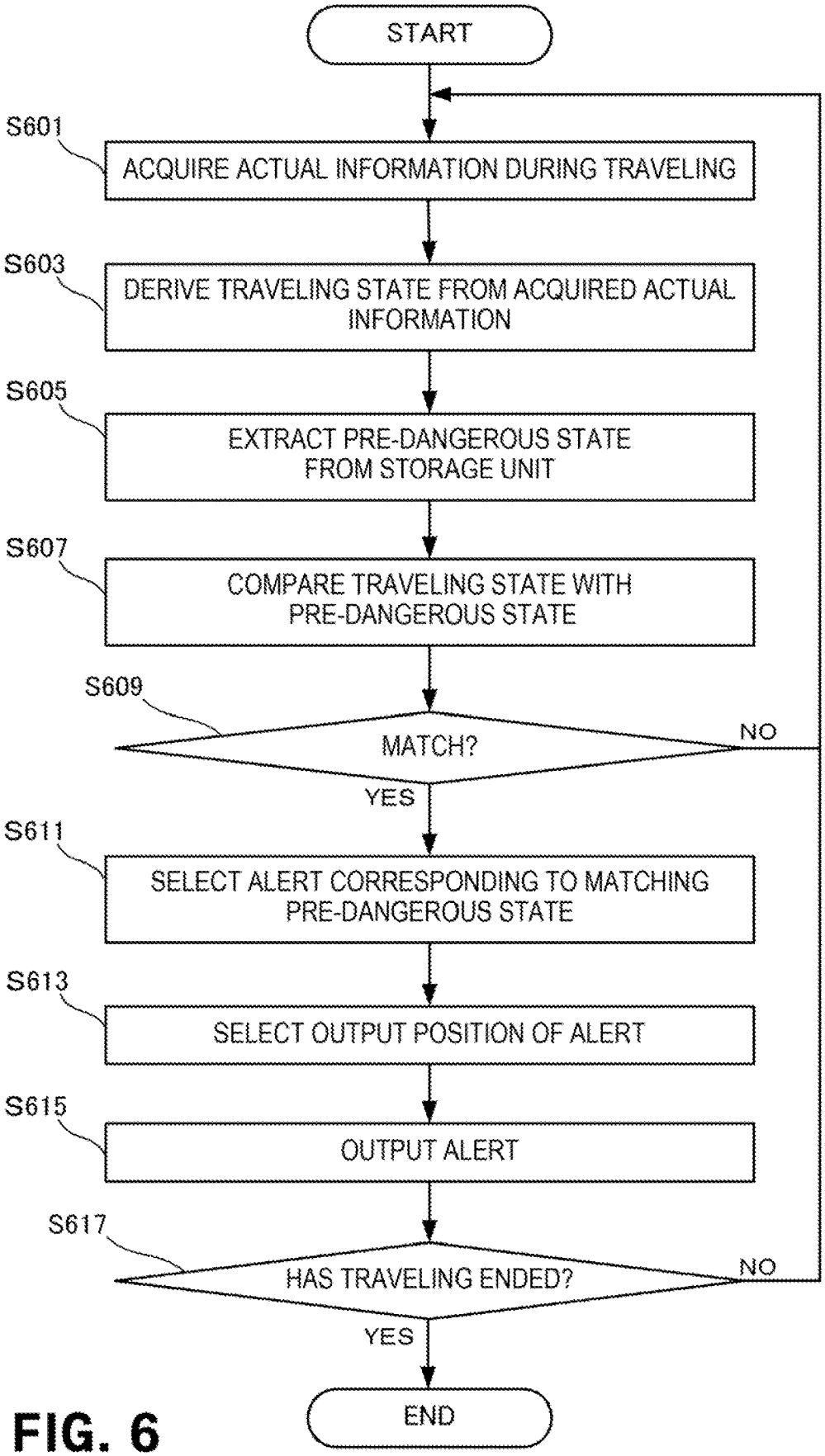
FIG. 6 is a flowchart for explaining the processing procedure of the information processing apparatus according to the second example embodiment of the present invention.

FIG. 6 is a flowchart for explaining the processing procedure of the information processing apparatus 200 according to this example embodiment. This flowchart is executed by the CPU 510 of FIG. 5 using the RAM 540, thereby implementing the functional components of the information processing apparatus 200 shown in FIG. 3.

In step S601, the information processing apparatus 200 acquires actual information from the vehicle 320 during traveling. In step S603, the information processing apparatus 200 derives the traveling state of the vehicle 320 based on the acquired actual information. In step S605, the information processing apparatus 200 extracts the pre-dangerous state 311 accumulated in the storage unit 301. In step S607, the information processing apparatus 200 compares the traveling state of the vehicle 320 derived from the actual information with information indicating the extracted pre-dangerous state 311. In step S609, the information processing apparatus 200 determines whether the traveling state of the vehicle 320 derived from the actual information matches the pre-dangerous state 311. If it is determined that the traveling state does not match the pre-dangerous state 311 (NO in step S609), the information processing apparatus 200 returns to step S601; otherwise (YES in step S609), the information processing apparatus 200 advances to step S611.

In step S611, the information processing apparatus 200 selects an alert corresponding to the type of the matching pre-dangerous state 311. In step S613, the information processing apparatus 200 selects the output position, in the vehicle, of the selected alert. In step S615, the information processing apparatus 200 controls output of the alert. In step S617, the information processing apparatus 200 determines whether traveling of the vehicle 320 has ended. The end of traveling can be determined by, for example, ON/OFF of the engine but the method of determining the end of traveling is not limited to this. Then, if it is determined that traveling of the vehicle 320 has not ended (NO in step S617), the information processing apparatus 200 returns to step S601; otherwise, the information processing apparatus 200 ends the processing.

According to this example embodiment, it is possible to alert the driver of a vehicle to various pre-dangerous states. Since the output position of an alert is selected, it is possible to notify the driver of the vehicle of an intuitional alert that is easy to understand.

Third Example Embodiment

Figure 7:
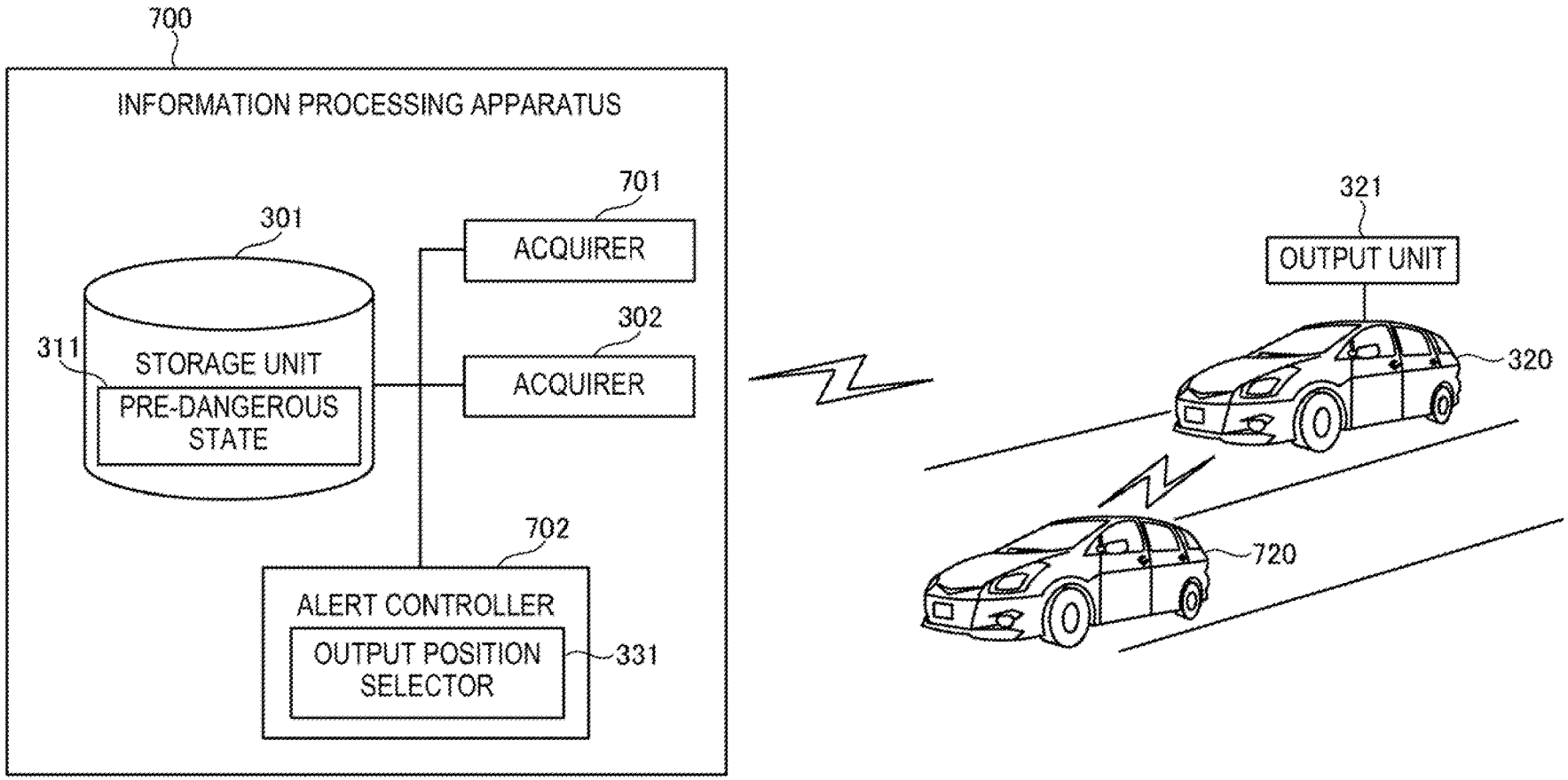
FIG. 7 is a block diagram showing the arrangement of an information processing apparatus according to the third example embodiment of the present invention.

An information processing apparatus according to the third example embodiment of the present invention will be described next with reference to FIGS. 7 to 10. FIG. 7 is a block diagram showing the arrangement of an information processing apparatus according to this example embodiment. The information processing apparatus according to this example embodiment is different from that according to the above-described second example embodiment in that an acquirer and an alert controller are provided. The remaining components and operations are similar to those in the second example embodiment. Hence, the same reference numerals denote similar components and operations, and a detailed description thereof will be omitted.

An information processing apparatus 700 includes an acquirer 701 and an alert controller 702. The acquirer 701 acquires inter-vehicle communication information by inter-vehicle communication between vehicles 320 and 720. The inter-vehicle communication indicates a system that acquires information of the vehicle 720 existing around the vehicle 320 by wireless communication between the vehicles 320 and 720. The information (inter-vehicle communication information) obtained by the inter-vehicle communication includes, for example, a position, a speed, acceleration/deceleration information, and vehicle control information, but is not limited to them.

The alert controller 702 controls output of an alert in consideration of the inter-vehicle communication information acquired by the acquirer 701. The alert controller 702 may obtain actual information of the vehicle 720 from the inter-vehicle communication information acquired from the vehicle 320.

The alert controller 702 performs comparison with information indicating a pre-dangerous state in consideration of the actual information of the vehicle 720 in addition to actual information of the vehicle 320, and controls output of an alert. The alert controller 702 may derive the traveling state of the vehicle 720 from, for example, the acquired actual information of the vehicle 720. Then, the derived traveling state of the vehicle 720 is compared with a pre-dangerous state 311, and it is determined whether the vehicle 720 is in the pre-dangerous state 311.

FIG. 8 is a table showing an example of an inter-vehicle communication information table 801 provided in the information processing apparatus 700 according to this example embodiment. The inter-vehicle communication information table 801 stores inter-vehicle communication information 812 in association with a vehicle ID (IDentifier) 811. The inter-vehicle communication information 812 includes the position and speed of the vehicle 720, acceleration/deceleration information, and vehicle control information.

Figure 9:
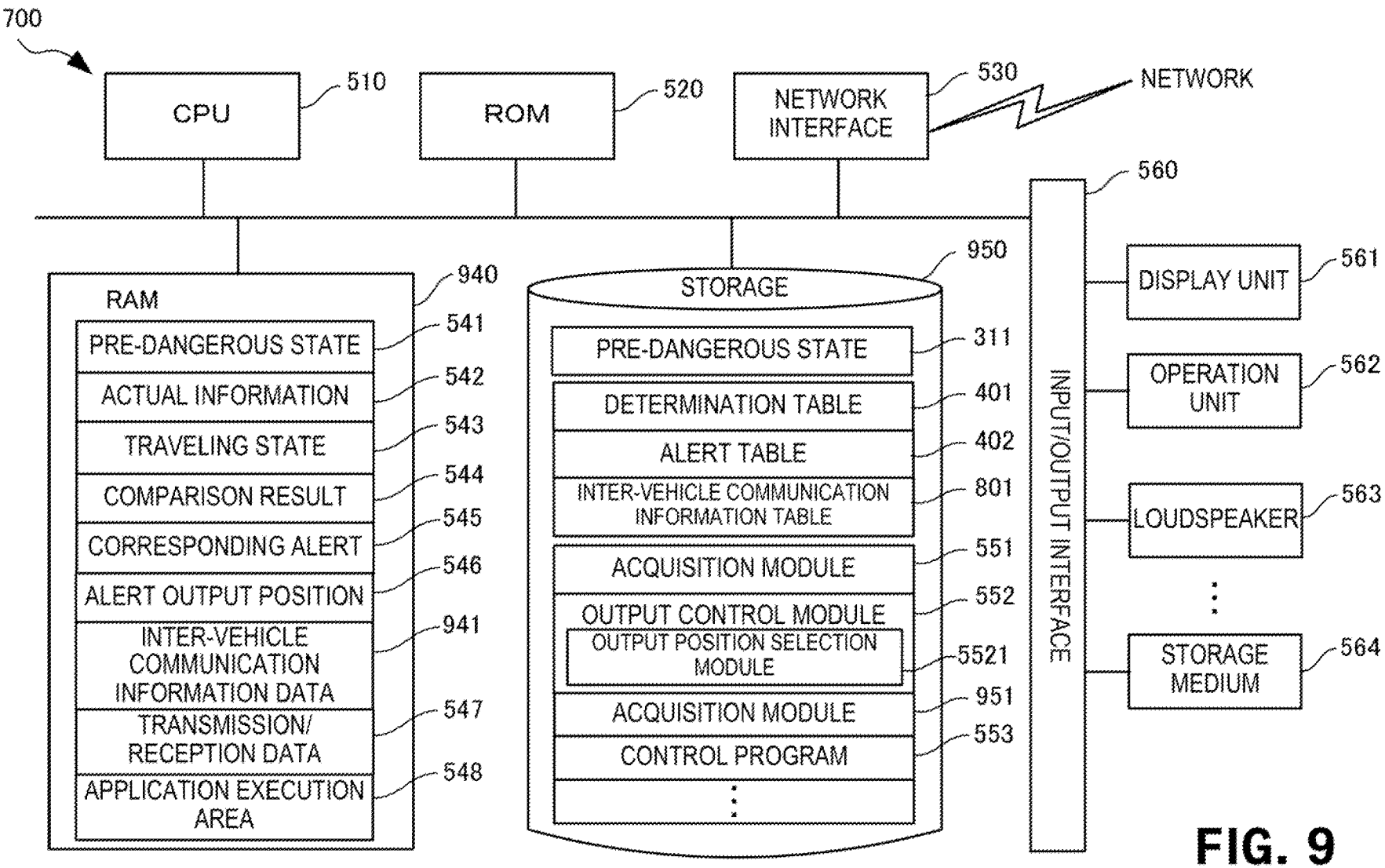
FIG. 9 is a block diagram for explaining the hardware arrangement of the information processing apparatus according to the third example embodiment of the present invention.

FIG. 9 is a block diagram showing the hardware arrangement of the information processing apparatus 700 according to this example embodiment. A CPU (Central Processing Unit) 510 is an arithmetic control processor, and implements the functional components of the information processing apparatus 700 shown in FIG. 8 by executing a program. The CPU 510 may include a plurality of processors to parallelly execute different programs, modules, tasks, or threads. A ROM (Read Only Memory) 520 stores permanent data such as initial data and a program, and other programs. A network interface 530 communicates with another apparatus or the like via a network. Note that the number of CPUs 510 is not limited to one, and a plurality of CPUs or a GPU (Graphics Processing Unit) for image processing may be included. The network interface 530 desirably includes a CPU independent of the CPU 510, and writes or reads transmission/reception data in or from the area of a RAM (Random Access Memory) 940. It is desirable to provide a DMAC (Direct Memory Access Controller) (not shown) for transferring data between the RAM 940 and a storage 950. An input/output interface 560 desirably includes a CPU independent of the CPU 510, and writes or reads input/output data in or from the area of the RAM 940. Therefore, the CPU 510 recognizes that data has been received by the RAM 940 or transferred to the RAM 940, and processes the data. The CPU 510 prepares a processing result in the RAM 940, and delegates succeeding transmission or transfer to the network interface 530, the DMAC, or the input/output interface 560.

The RAM 940 is a random access memory used as a temporary storage work area by the CPU 510. An area to store data necessary for implementation of this example embodiment is allocated to the RAM 940. Inter-vehicle communication information data 941 is information about the position and speed of the vehicle 720 and the like obtained by the inter-vehicle communication. This data is loaded from, for example, the inter-vehicle communication information table 801.

The storage 950 stores a database, various parameters, or the following data or programs necessary for implementation of this example embodiment. The storage 950 also stores the inter-vehicle communication information table 801. The inter-vehicle communication information table 801 is the table, shown in FIG. 8, for managing the relationship between the vehicle ID 811 and the inter-vehicle communication information 812.

The storage 950 also stores an acquisition module 951. The acquisition module 951 is a module that acquires the inter-vehicle communication information by the inter-vehicle communication between the vehicles 320 and 720. This module 951 is read out by the CPU 510 into an application execution area 548 of the RAM 940, and executed. A control program 553 is a program for controlling the whole information processing apparatus 700.

Figure 10:
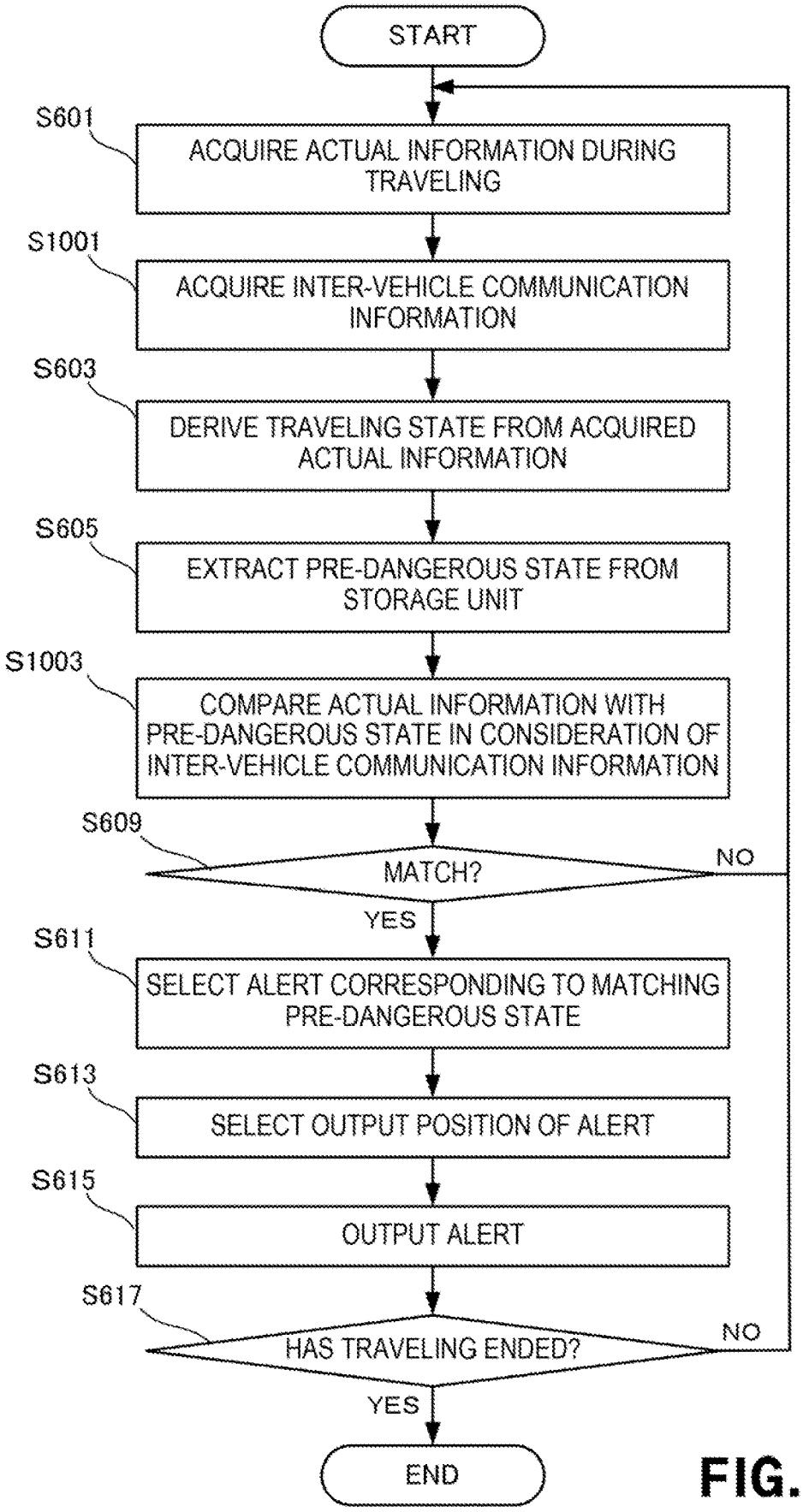
FIG. 10 is a flowchart for explaining the processing procedure of the information processing apparatus according to the third example embodiment of the present invention.

FIG. 10 is a flowchart for explaining the processing procedure of the information processing apparatus 700 according to this example embodiment. This flowchart is executed by the CPU 510 of FIG. 9 using the RAM 940, thereby implementing the functional components of the information processing apparatus 700 shown in FIG. 7.

In step S1001, the information processing apparatus 700 acquires inter-vehicle communication information. In step S1003, the information processing apparatus 700 compares the actual information of the vehicle 320 with the information indicating the pre-dangerous state in consideration of the acquired inter-vehicle communication information.

According to this example embodiment, it is possible to alert the driver of a vehicle to various pre-dangerous states. Since the information of a vehicle existing around a self-vehicle is considered by the inter-vehicle communication, a pre-dangerous state can be determined more correctly in more detail. Furthermore, since whether a vehicle is in a pre-dangerous state is determined more correctly, it is possible to suppress useless output of an alert, and to notify the driver of a correct alert.

Fourth Example Embodiment

Figure 11:
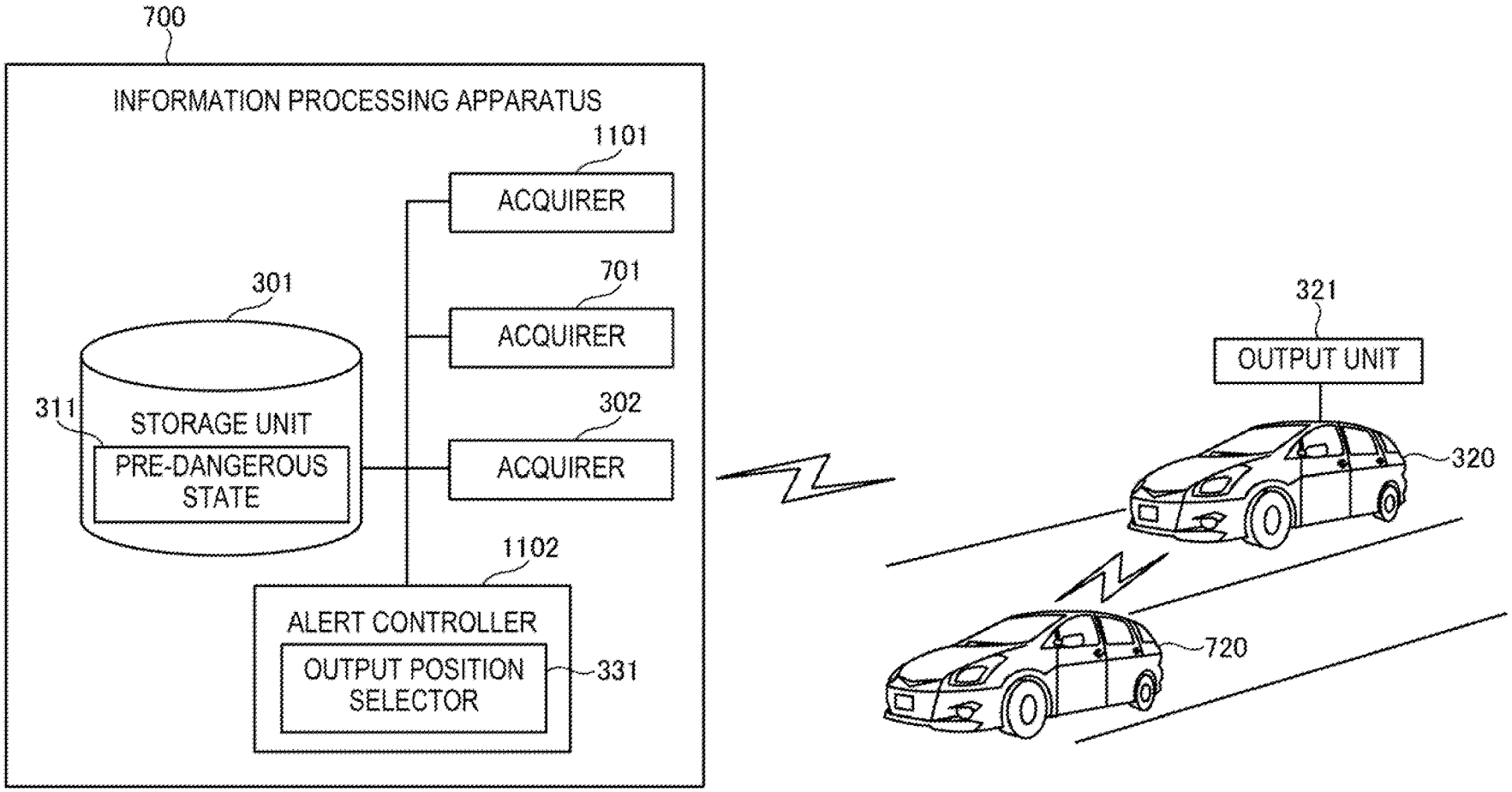
FIG. 11 is a block diagram showing the arrangement of an information processing apparatus according to the fourth example embodiment of the present invention.

An information processing apparatus according to the fourth example embodiment of the present invention will be described next with reference to FIGS. 11 to 14. FIG. 11 is a block diagram showing the arrangement of an information processing apparatus 1100 according to this example embodiment. The information processing apparatus 1100 according to this example embodiment is different from those according to the above-described second and third example embodiments in that an acquirer and an alert controller are provided. The remaining components and operations are similar to those in the second and third example embodiments. Hence, the same reference numerals denote similar components and operations, and a detailed description thereof will be omitted.

The information processing apparatus 1100 includes an acquirer 1101 and an alert controller 1102. The acquirer 1101 acquires at least one of the attribute of the driver of a vehicle 320 and the attribute of the vehicle. The attribute of the driver includes an age, sex, driving history, accident history, nationality, eye sight, hearing ability, height, weight, and color vision but are not limited to them. The attribute of the vehicle includes a vehicle type, engine displacement, vehicle size (whole length, vehicle height, and wheelbase), vehicle weight, brake performance, and tire performance (type, size, and the like) but are not limited to them.

The alert controller 1102 controls output of an alert in consideration of at least one of the attribute of the driver and that of the vehicle 320 acquired by the acquirer 1101. For example, if the driver has auditory disorder, the alert controller 1102 controls output of a visual alert such as light instead of output of an auditory alert such as a sound.

FIG. 12 is a table showing an example of an attribute table 1201 provided in the information processing apparatus 1100 according to this example embodiment. The attribute table 1201 stores attribute information 1211 in association with a vehicle ID 811. The attribute information 1211 is information of at least one of the attribute of the driver of the vehicle 320 and that of the vehicle 320.

Figure 13:
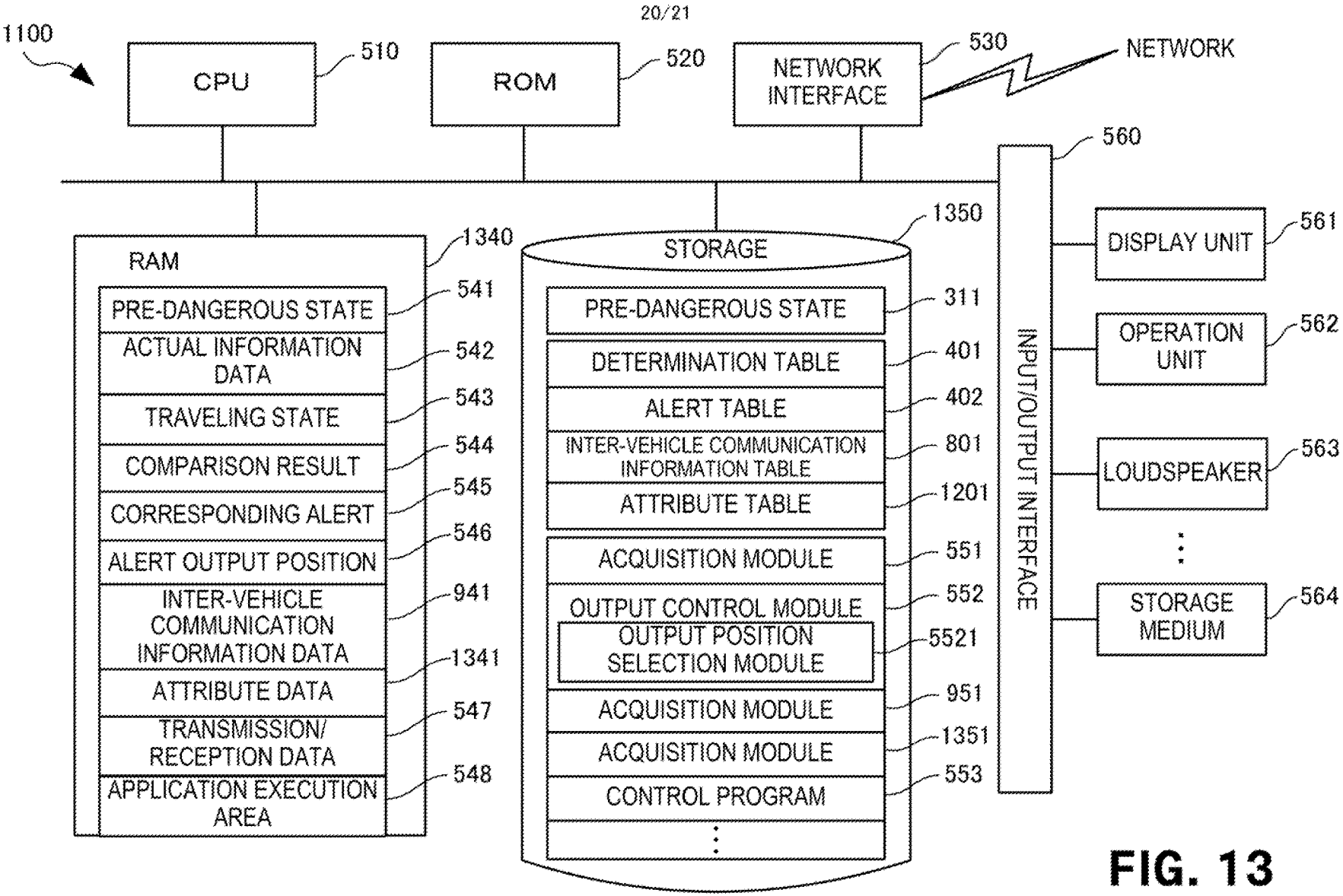
FIG. 13 is a block diagram for explaining the hardware arrangement of the information processing apparatus according to the fourth example embodiment of the present invention.

FIG. 13 is a block diagram for explaining the hardware arrangement of the information processing apparatus 1100 according to this example embodiment. A CPU (Central Processing Unit) 510 is an arithmetic control processor, and implements the functional components of the information processing apparatus 1100 shown in FIG. 11 by executing a program. The CPU 510 may include a plurality of processors to parallelly execute different programs, modules, tasks, or threads. A ROM (Read Only Memory) 520 stores permanent data such as initial data and a program, and other programs. A network interface 530 communicates with another apparatus or the like via a network. Note that the number of CPUs 510 is not limited to one, and a plurality of CPUs or a GPU (Graphics Processing Unit) for image processing may be included. The network interface 530 desirably includes a CPU independent of the CPU 510, and writes or reads transmission/reception data in or from the area of a RAM (Random Access Memory) 1340. It is desirable to provide a DMAC (Direct Memory Access Controller) (not shown) for transferring data between the RAM 1340 and a storage 1350. An input/output interface 560 desirably includes a CPU independent of the CPU 510, and writes or reads input/output data in or from the area of the RAM 1340. Therefore, the CPU 510 recognizes that data has been received by the RAM 1340 or transferred to the RAM 1340, and processes the data. The CPU 510 prepares a processing result in the RAM 1340, and delegates succeeding transmission or transfer to the network interface 530, the DMAC, or the input/output interface 560.

The RAM 1340 is a random access memory used as a temporary storage work area by the CPU 510. An area to store data necessary for implementation of this example embodiment is allocated to the RAM 1340. Attribute data 1341 is data including at least one of the attribute of the driver of the vehicle 320 and that of the vehicle 320. This data is loaded from, for example, the attribute table 1201.

The storage 1350 stores a database, various parameters, or the following data or programs necessary for implementation of this example embodiment. The storage 1350 also stores the attribute table 1201. The attribute table 1201 is the table, shown in FIG. 12, for managing the relationship between the vehicle ID 811 and the attribute information 1211.

The storage 1350 also stores an acquisition module 1351. The acquisition module 1351 is a module that acquires at least one of the attribute of the driver of the vehicle 320 and that of the vehicle 320. This module 1351 is read out by the CPU 510 into an application execution area 548 of the RAM 1340, and executed. A control program 553 is a program for controlling the whole information processing apparatus 1100.

Figure 14:
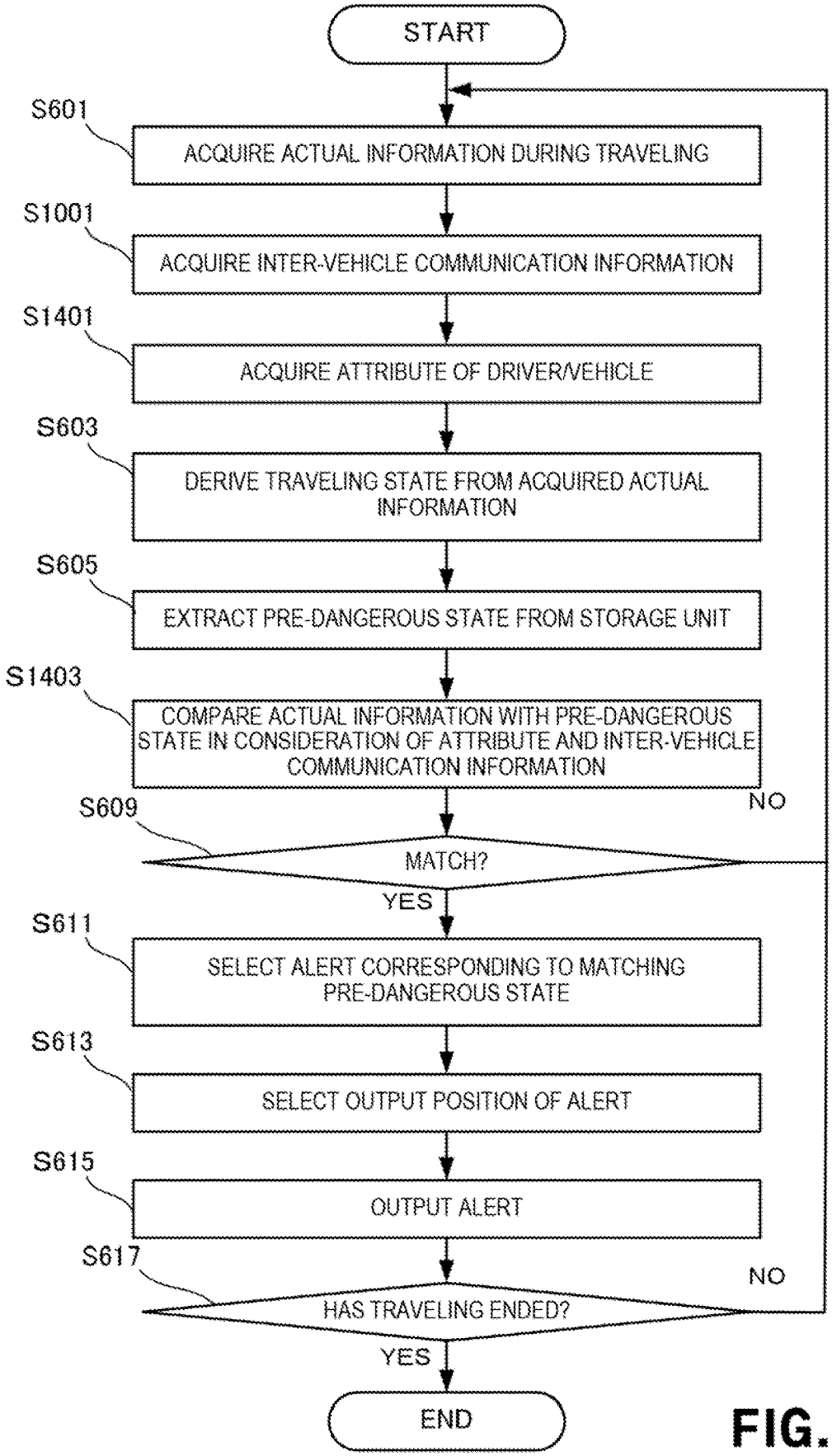
FIG. 14 is a flowchart for explaining the processing procedure of the information processing apparatus according to the fourth example embodiment of the present invention.

FIG. 14 is a flowchart for explaining the processing procedure of the information processing apparatus 1100 according to this example embodiment. This flowchart is executed by the CPU 510 of FIG. 13 using the RAM 1340, thereby implementing the functional components of the information processing apparatus 1100 shown in FIG. 11.

In step S1401, the information processing apparatus 1100 acquires at least one of the attribute of the driver of the vehicle 320 and that of the vehicle 320. In step S1403, the information processing apparatus 1100 compares the actual information of the vehicle 320 with the information indicating the pre-dangerous state in consideration of at least one of the acquired attribute of the driver and that of the vehicle 320.

According to this example embodiment, it is possible to alert the driver of a vehicle to various pre-dangerous states. By considering the attribute of the driver of the vehicle or that of the vehicle, a pre-dangerous state can be determined more correctly in more detail. Furthermore, since at least one of the attribute of the driver and that of the vehicle is acquired, it is possible to control output of an alert corresponding to the attribute of the driver or that of the vehicle.

Other Example Embodiments

While the invention has been particularly shown and described with reference to example embodiments thereof, the invention is not limited to these example embodiments. It will be understood by those of ordinary skill in the art that various changes in form and details may be made therein without departing from the spirit and scope of the present invention as defined by the claims. A system or apparatus including any combination of the individual features included in the respective example embodiments may be incorporated in the scope of the present invention.

The present invention is applicable to a system including a plurality of devices or a single apparatus. The present invention is also applicable even when an information processing program for implementing the functions of example embodiments is supplied to the system or apparatus directly or from a remote site. Hence, the present invention also incorporates the program installed in a computer to implement the functions of the present invention by the computer, a medium storing the program, and a WWW (World Wide Web) server that causes a user to download the program. Especially, the present invention incorporates at least a non-transitory computer readable medium storing a program that causes a computer to execute processing steps included in the above-described example embodiments.

Other Expressions of Example Embodiments

Some or all of the above-described example embodiments can also be described as in the following supplementary notes but are not limited to the followings.

(Supplementary Note 1)

There is provided an information processing apparatus comprising:

a storage unit that stores information obtained by a traveling simulation of a vehicle in a virtual environment and indicating a pre-dangerous state before the vehicle is set in a dangerous state;

a first acquirer that acquires actual information during traveling of the vehicle; and an alert controller that provides an alert of occurrence of the pre-dangerous state based on the actual information acquired by the first acquirer and the information indicating the pre-dangerous state.

(Supplementary Note 2)

There is provided the information processing apparatus according to supplementary note 1, wherein the alert controller controls output of an alert corresponding to a type of the pre-dangerous state.

(Supplementary Note 3)

There is provided the information processing apparatus according to supplementary note 1 or 2, wherein the pre-dangerous state includes at least one of cut-in of another vehicle in front of the vehicle, a lane change of the vehicle, and running-out of a person from a blind spot.

(Supplementary Note 4)

There is provided the information processing apparatus according to supplementary note 2 or 3, wherein the alert controller controls to select and output an output position, in the vehicle, of the alert corresponding to the type of the pre-dangerous state.

(Supplementary Note 5)

There is provided the information processing apparatus according to supplementary note 4, wherein if the pre-dangerous state is cut-in of another vehicle in front of the vehicle, the alert controller controls to select and output a front side of a driver of the vehicle as the output position.

(Supplementary Note 6)

There is provided the information processing apparatus according to supplementary note 4, wherein if the pre-dangerous state is a lane change of the vehicle, the alert controller controls to select and output a direction of a blind spot of the vehicle as the output position.

(Supplementary Note 7)

There is provided the information processing apparatus according to supplementary note 4, wherein if the pre-dangerous state is running-out of a person from a blind spot of the vehicle, the alert controller controls to select and output, as the output position, a direction from which the person runs out.

(Supplementary Note 8)

There is provided the information processing apparatus according to any one of supplementary notes 1 to 7, further comprising a second acquirer that acquires inter-vehicle communication information by inter-vehicle communication between the vehicles, wherein the alert controller controls output of the alert in consideration of the inter-vehicle communication information acquired by the second acquirer.

(Supplementary Note 9)

There is provided the information processing apparatus according to any one of supplementary notes 1 to 8, further comprising a third acquirer that acquires at least one of an attribute of a driver of the vehicle and an attribute of the vehicle, wherein the alert controller controls output of the alert in consideration of at least one of the attribute of the driver and the attribute of the vehicle acquired by the third acquirer.

(Supplementary Note 10)

There is provided an information processing method comprising:

acquiring actual information during traveling of a vehicle; and providing an alert of occurrence of a pre-dangerous state based on the actual information acquired in the acquiring and information obtained by a traveling simulation of the vehicle in a virtual environment and indicating the pre-dangerous state which is before the vehicle is set in a dangerous state and is stored in a storage unit.

(Supplementary Note 11)

There is provided an information processing program for causing a computer to execute a method, comprising:

acquiring actual information during traveling of a vehicle; and providing an alert of occurrence of a pre-dangerous state based on the actual information acquired in the acquiring and information obtained by a traveling simulation of the vehicle in a virtual environment and indicating the pre-dangerous state which is before the vehicle is set in a dangerous state and is stored in a storage unit.

What is claimed is:

1. An information processing apparatus comprising:

a storage unit that stores information obtained by a traveling simulation of a virtual vehicle in a virtual environment and indicating a pre-dangerous state before the virtual vehicle is set in a dangerous state;

a first acquirer that acquires actual information during traveling of a real vehicle in a real environment; and an alert controller that provides an alert of occurrence of the pre-dangerous state based on the actual information acquired by said first acquirer and the information indicating the pre-dangerous state stored in advance in the storage unit, wherein the information indicating the pre-dangerous state represents a state of the virtual vehicle at a predetermined number of frames or a predetermined time before a traffic accident, the traffic accident having occurred in the traveling simulation in the virtual environment.

2. The information processing apparatus according to claim 1, wherein the pre-dangerous state includes at least one of cut-in of another virtual vehicle in front of the virtual vehicle, a lane change of the virtual vehicle, and running-out of a person from a blind spot.

3. The information processing apparatus according to claim 1, wherein if the pre-dangerous state is cut-in of another virtual vehicle in front of the virtual vehicle, said alert controller controls to select and output a front side of a driver of the real vehicle as an output position.

4. The information processing apparatus according to claim 1, wherein if the pre-dangerous state is a lane change of the virtual vehicle, said alert controller controls to select and output a direction of a blind spot of the real vehicle as an output position.

5. The information processing apparatus according to claim 1, wherein if the pre-dangerous state is running-out of a person from a blind spot of the virtual vehicle, said alert controller controls to select and output, as an output position, a direction from which the person runs out.

6. The information processing apparatus according to claim 1, further comprising a second acquirer that acquires inter-vehicle communication information by inter-vehicle communication between the real vehicle and another real vehicle, wherein said alert controller controls output of the alert in consideration of the inter-vehicle communication information acquired by said second acquirer.

7. The information processing apparatus according to claim 1, further comprising a third acquirer that acquires at least one of an attribute of a driver of the real vehicle and an attribute of the real vehicle, wherein said alert controller controls output of the alert in consideration of at least one of the attribute of the driver and the attribute of the real vehicle acquired by said third acquirer.

8. An information processing apparatus according to claim 1, wherein the information indicating the pre-dangerous state is preliminary stored and includes at least one of a video data of a front camera of the virtual vehicle in the pre-dangerous state, a speed and acceleration data of the virtual vehicle in the pre-dangerous state, and a rudder angle data of a steering wheel of the virtual vehicle.

9. An information processing method comprising:

acquiring actual information during traveling of a real vehicle in a real environment; and providing an alert of occurrence of a pre-dangerous state based on the actual information acquired in the acquiring and information obtained by a traveling simulation of a virtual vehicle in a virtual environment and indicating the pre-dangerous state which is before the virtual vehicle is set in a dangerous state and is stored in advance in a storage unit, wherein the information indicating the pre-dangerous state represents a state of the virtual vehicle at a predetermined number of frames or a predetermined time before a traffic accident, the traffic accident having occurred in the traveling simulation in the virtual environment.

10. A non-transitory computer readable medium storing an information processing program for causing a computer to execute a method, comprising:

acquiring actual information during traveling of a real vehicle in a real environment; and providing an alert of occurrence of a pre-dangerous state based on the actual information acquired in the acquiring and information obtained by a traveling simulation of a virtual vehicle in a virtual environment and indicating the pre-dangerous state which is before the virtual vehicle is set in a dangerous state and is stored in advance in a storage unit, wherein the information indicating the pre-dangerous state represents a state of the virtual vehicle at a predetermined number of frames or a predetermined time before a traffic accident, the traffic accident having occurred in the traveling simulation in the virtual environment.

* * * * *